US010705442B2

(12) United States Patent
Moffat et al.

(10) Patent No.: US 10,705,442 B2
(45) Date of Patent: Jul. 7, 2020

(54) TONER COMPOSITIONS WITH WHITE COLORANTS AND PROCESSES OF MAKING THEREOF

(71) Applicant: XEROX CORPORATION, Norwalk, CT (US)

(72) Inventors: Karen A. Moffat, Brantford (CA); David J. W. Lawton, Oakville (CA); Melanie L. Davis, Hamilton (CA); Juan A. Morales-Tirado, Henrietta, NY (US); Varun Sambhy, Pittsford, NY (US)

(73) Assignee: XEROX CORPORATION, Norwalk, CT (US)

( * ) Notice: Subject to any disclaimer, the term of this patent is extended or adjusted under 35 U.S.C. 154(b) by 315 days.

(21) Appl. No.: 15/227,827

(22) Filed: Aug. 3, 2016

(65) Prior Publication Data

US 2018/0039194 A1 Feb. 8, 2018

(51) Int. Cl.

| | |
|---|---|
| ***G03G 9/09*** | (2006.01) |
| ***G03G 9/08*** | (2006.01) |
| ***G03G 9/087*** | (2006.01) |

(52) U.S. Cl.

CPC ..... *G03G 9/0902* (2013.01); *G03G 9/0819* (2013.01); *G03G 9/0821* (2013.01); *G03G 9/08755* (2013.01); *G03G 9/08795* (2013.01); *G03G 9/08797* (2013.01); *G03G 9/0926* (2013.01)

(58) Field of Classification Search

CPC . G03G 9/0902; G03G 9/0819; G03G 9/08755
See application file for complete search history.

(56) References Cited

U.S. PATENT DOCUMENTS

| | | | |
|---|---|---|---|
| 3,236,776 | A | 2/1966 | Tomanek et al. |
| 4,312,932 | A | 1/1982 | Hauser et al. |
| 4,797,339 | A | 1/1989 | Maruyama et al. |
| 4,855,204 | A | 8/1989 | Fujii et al. |
| 4,943,506 | A | 7/1990 | Demizu et al. |
| 4,983,488 | A | 1/1991 | Tan et al. |
| 4,996,127 | A | 2/1991 | Hasegawa et al. |
| 5,077,158 | A | 12/1991 | Nakano |
| 5,278,020 | A | 1/1994 | Grushkin et al. |
| 5,290,654 | A | 3/1994 | Sacripante et al. |
| 5,308,734 | A | 5/1994 | Sacripante et al. |
| 5,344,738 | A | 9/1994 | Kmiecik-Lawrynowicz et al. |
| 5,346,797 | A | 9/1994 | Kmiecik-Lawrynowicz et al. |

(Continued)

FOREIGN PATENT DOCUMENTS

| | | |
|---|---|---|
| EP | 2 290 454 A1 | 3/2011 |
| JP | 59-172652 A | 9/1984 |

OTHER PUBLICATIONS

DuPont™ Ti-Pure® titanium dioxide, Titanium Dioxide for Coatings, 28-pages.

(Continued)

*Primary Examiner* — Thorl Chea
(74) *Attorney, Agent, or Firm* — Pillsbury Winthrop Shaw Pittman LLP

(57) ABSTRACT

The present disclosure relates to toner compositions containing a high loading of white colorant of greater than 30 weight % by weight of the toner and processes thereof. The toner exhibits a lightness (L*) of at least 75.

19 Claims, 5 Drawing Sheets

(56) References Cited

U.S. PATENT DOCUMENTS

| | | | |
|---|---|---|---|
| 5,348,832 | A | 9/1994 | Sacripante et al. |
| 5,364,729 | A | 11/1994 | Kmiecik-Lawrynowicz et al. |
| 5,366,841 | A | 11/1994 | Patel et al. |
| 5,370,963 | A | 12/1994 | Patel et al. |
| 5,403,693 | A | 4/1995 | Patel et al. |
| 5,405,728 | A | 4/1995 | Hopper et al. |
| 5,418,108 | A | 5/1995 | Kmiecik-Lawrynowicz et al. |
| 5,496,676 | A | 3/1996 | Croucher et al. |
| 5,501,935 | A | 3/1996 | Patel et al. |
| 5,506,671 | A | 4/1996 | Buts et al. |
| 5,527,658 | A | 6/1996 | Hopper et al. |
| 5,585,215 | A | 12/1996 | Ong et al. |
| 5,635,326 | A | 6/1997 | Kanbayashi et al. |
| 5,650,255 | A | 7/1997 | Ng et al. |
| 5,650,256 | A | 7/1997 | Veregin et al. |
| 5,716,751 | A | 2/1998 | Bertrand et al. |
| 5,866,286 | A | 2/1999 | Christy et al. |
| 6,063,827 | A | 5/2000 | Sacripante et al. |
| 6,114,077 | A | 9/2000 | Voets et al. |
| 6,162,573 | A | 12/2000 | Grande et al. |
| 6,593,049 | B1 | 7/2003 | Veregin et al. |
| 6,756,176 | B2 | 6/2004 | Stegamat et al. |
| 6,830,860 | B2 | 12/2004 | Sacripante et al. |
| 6,921,617 | B2 | 7/2005 | Iida et al. |
| 8,903,281 | B2 | 12/2014 | Koido |
| 9,134,635 | B1 | 9/2015 | Lawton et al. |
| 9,182,691 | B2 | 11/2015 | Lawton et al. |
| 2006/0222991 | A1 | 10/2006 | Sacripante et al. |
| 2010/0136472 | A1 | 6/2010 | McDougall et al. |
| 2011/0052882 | A1 | 3/2011 | Gong et al. |
| 2011/0183247 | A1* | 7/2011 | Kadokura ..... G03G 9/0827 430/105 |
| 2012/0070776 | A1* | 3/2012 | Nosella ..... G03G 9/0804 430/137.14 |
| 2012/0189950 | A1* | 7/2012 | Sugitate ..... G03G 9/09708 430/105 |
| 2014/0045116 | A1 | 2/2014 | Agur et al. |
| 2017/0242366 | A1 | 8/2017 | Kamiwaki et al. |

OTHER PUBLICATIONS

Extended European Search Report re: Xerox Corporation's Patent Application No. 17182705.8 dated Nov. 9, 2017, eight pages.

* cited by examiner

TONER COMPOSITIONS WITH WHITE COLORANTS AND PROCESSES OF MAKING THEREOF

BACKGROUND

The present disclosure is directed to toner compositions containing a white colorant and processes of making thereof. More specifically, the toner compositions include toner particles having a high loading of white colorants, such as, for example, greater than 30% by weight of the toner, and exhibit high lightness values. In embodiments, the toner compositions are suitable for use in offset lithography (or offset printing). Lithography is common for use in digital label press and packaging printing.

In the offset process, the image may be indirectly applied to the media, such as paper or other materials, through an intermediate transfer, or blanket cylinder, whereby the image from the plate is applied first to a blanket cylinder, which then offsets, or transfers, from the blanket cylinder to the media.

In order to compete effectively with offset printing, or for high quality color applications or for special effects, lithographic printers often add a fifth xerographic station to enable gamut extension via the addition of a fifth color. At any given time, the lithographic printing machine runs CMYK toners plus a fifth color in the fifth station, depending on the color space where the gamut extension is desired. A fifth color is any spot color used in addition to the four color CMYK mix (Cyan, Magenta, Yellow and Black).

White toners can be used as the fifth color for color gamut enhancement. White toner has the ability to make the colors light and to extend the upper part of the spot color gamut in the high L* range, where L* is a measure of the lightness of the color.

In current high speed production electrophotography of xerography printing, the color gamut for high L* region is limited by the white pigment loading of the toner particles. Thus, there is a need for a white toner with high pigment loading to produce white images on black substrates with an L* close to 75 or higher either by single or multiple pass development.

SUMMARY

According to embodiments illustrated herein, there is provided a toner an emulsion aggregation toner having toner particles comprising a white colorant in an amount of from about 30 weight percent to 65 weight percent by weight of the toner: a crystalline polyester resin; and an amorphous polyester resin; wherein the toner exhibits a lightness (L*) of from about 75 to about 95 at a pigment mass per unit area of from about 0.2 mg/cm$^2$ to about 1.5 mg/cm$^2$ based on the surface area of a black substrate.

In specific embodiments, there is provided a an emulsion aggregation toner having toner particles comprising titanium dioxide in an amount of from about 35 weight percent to 55 weight percent by weight of the toner; a crystalline polyester resin; an amorphous polyester resin; and an anionic surfactant; wherein the toner exhibits a lightness (L*) of from about 75 to about 95 at a pigment mass per unit area from about 0.2 mg/cm$^2$ to about 1.5 mg/cm$^2$ based on the surface area of a black substrate.

BRIEF DESCRIPTION OF THE DRAWINGS

For a better understanding of the present embodiments, reference may be made to the accompanying figures.

DETAILED DESCRIPTION

Figure 1:
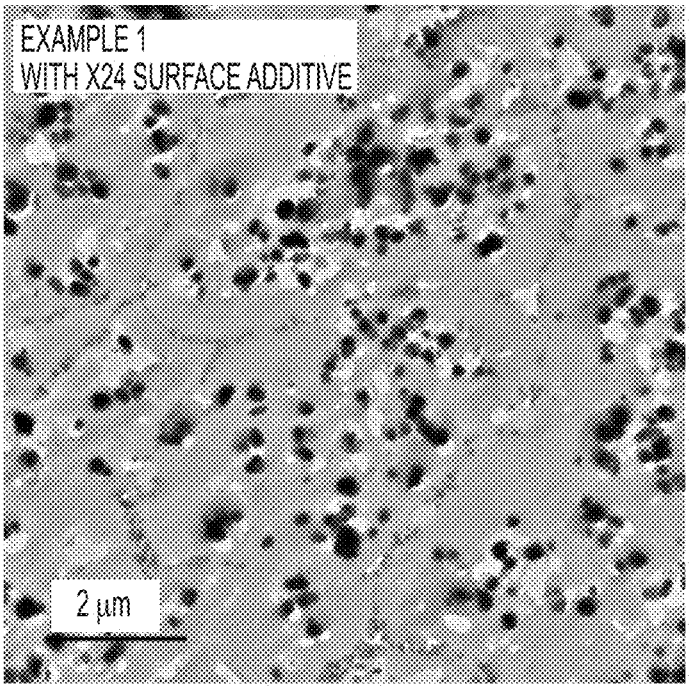
FIG. 1 is a transmission electron microscope (TEM) photograph of a cross-sectional view of $TiO_2$ pigment dispersion within EA particles of Example 1 prepared according to certain embodiments of the present disclosure.

In the following description, it is understood that other embodiments may be utilized and structural and operational changes may be made without departure from the scope of the present embodiments disclosed herein.

In this specification and the claims that follow, singular forms such as "a," "an," and "the" include plural forms unless the content clearly dictates otherwise. All ranges disclosed herein include, unless specifically indicated, all endpoints and intermediate values.

The present embodiments provide a white toner composition having a lightness (L*) value of at least 65, in embodiments from about 70 to about 99, from about 75 to about 95, from about 75 to about 90 at a pigment mass per unit area of from about 0.2 mg/cm$^2$ to about 1.5 mg/cm$^2$, from about 0.3 mg/cm$^2$ to about 1.5 mg/cm$^2$, from about 0.2 mg/cm$^2$ to about 1.3 mg/cm$^2$, from about 0.2 mg/cm$^2$ to about 1.2 mg/cm$^2$, from about 0.3 mg/cm$^2$ to about 1.2 mg/cm$^2$, or from about 0.4 mg/cm$^2$ to about 1.2 mg/cm$^2$. Measurement of the color gamut was characterized by CIE (Commission International de l'Eclairage) specifications, commonly referred to as CIE-Lab, where L*, a* and b* are the modified opponent color coordinates forming a 3 dimensional space. L* characterizes the lightness of a color, a* approximately characterizes the redness and—a* characterizes greenness, and b* approximately characterizes the yellowness and—b* characterizes the blueness of a color. The CIE-Lab system is useful as a three-dimensional system for the quantitative description of color loci. On one axis in the system the colors green (negative a* values) and red (positive a* values) are plotted, on the axis at right angles thereto the colors blue (negative b* values) and yellow (positive b* values) are plotted. The value C*, further defined as the color saturation, is composed of a* and b* as follows: $C^*=(a^{*2}+b^{*2})^{0.5}$ and is used to describe violet color loci. The two axes intersect one another at the achromatic point. The vertical axis (achromatic axis) is relevant for the lightness, from white (L*=100) to black (L*=0). All of these parameters may be measured with an industry standard spectrophotometer, for instance, a Gretag Macbeth 7000A Color eye spectrophotometer from X-Rite Corporation. Using the CIE-Lab system it is thus possible to describe not only color loci but also color spacings, by stating the three coordinates. The L* values disclosed herein are based on white images onto a black substrate. It should be understood that the L* varies depending on how the L* is measured and whether if the L* is measured based on a clear substrate or a colored substrate. For example, the L* value measured based on a clear substrate is different from the L* value measure based on a dark (e.g., black) substrate.

In embodiments, the toner of the present disclosure is suitable for xerographic (also known as electrophotography) applications. Xerographic toners possess physical and chemical properties that are specific to xerographic printing systems.

In embodiments, the toner of the present disclosure is a dry toner powder for xerographic applications. The toner of the present disclosure is an emulsion aggregation (EA) toner having toner particles comprising a white colorant and a binder. The EA toner can be prepared by a conventional emulsion aggregation process or by a batch aggregation/continuous coalescence process or by a continuous aggregation/coalescence emulsion aggregation process. In embodiments, the toner of the present disclosure is a dry powder. The term "dry powder" as used herein refers to a composition that contains finely dispersed dry toner particles. Such a dry powder or dry particle may contain up to about 5%, up to about 2%, up to about 1%, or up to about 0.1% water or other solvent, or be substantially free of water or other solvent, or be anhydrous. In embodiments, the toner of the present disclosure contains a core and a shell.

The toner of the present disclosure includes a white colorant, where the white colorant loading in the toner particles is greater than 30 weight percent, from about 30 to about 65 weight percent, from about 35 to about 60 weight percent, from about 40 to about 55 weight percent, from about 40 to about 50 weight percent, or from about 40 to about 50 weight percent, based on the total weight of the toner composition.

The white colorant (e.g., white pigment) is generally an inorganic material, such as, titanium oxide, zinc oxide, zinc sulfide or mixtures thereof. The white pigment particles may be untreated or surface treated with silica, alumina, or tin oxide. The average particle size (diameter) of the white pigment can be from about 150 nm to about 700 nm, from about 200 nm to about 600 nm, or from about 250 nm to about 550 nm.

The toner composition of the present disclosure includes a polyester resin. The polyester resin may be crystalline, amorphous or mixtures thereof. Suitable polyester resins include, for example, crystalline, amorphous, mixtures thereof, and the like. The polyester resins may be linear, branched, mixtures thereof, and the like. Polyester resins may include, in embodiments, those resins described in U.S. Pat. Nos. 6,593,049 and 6,756,176, the disclosure of each of which hereby is incorporated by reference in entirety. Suitable resins include a mixture of an amorphous polyester resin and a crystalline polyester resin as described in U.S. Pat. No. 6,830,860, the disclosure of which is hereby incorporated by reference in entirety.

To enable the highly loaded white colorant toner particles of the present disclosure to fuse well to the substrate, the polyester resins selected should enable low melting fusing performance such that the rheological properties (e.g., dynamic viscosity) of the toner particles is comparable or lower than that of the conventional melt mixing/grinding of toner particles that contains less than 30% colorant.

Crystalline Resins

In embodiments, the crystalline resin may be a polyester resin formed by reacting a diol with a diacid in the presence of an optional catalyst. For forming a crystalline polyester, suitable organic diols include aliphatic diols with from about 2 to about 36 carbon atoms, such as 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol and the like; alkali sulfo-aliphatic diols such as sodio 2-sulfo-1,2-ethanediol, lithio 2-sulfo-1,2-ethanediol, potassio 2-sulfo-1,2-ethanediol, sodio 2-sulfo-1,3-propanediol, lithio 2-sulfo-1,3-propanediol, potassio 2-sulfo-1,3-propanediol, mixtures thereof, and the like. The aliphatic diol may be, for example, selected in an amount of from about 40 to about 60 mole % (although amounts outside of those ranges may be used).

Examples of organic diacids or diesters including vinyl diacids or vinyl diesters selected for the preparation of the crystalline resins include oxalic acid, succinic acid, glutaric acid, adipic acid, suberic acid, azelaic acid, sebacic acid, fumaric acid, dimethyl fumarate, dimethyl itaconate, cis-1,4-diacetoxy-2-butene, diethyl fumarate, diethyl maleate, phthalic acid, isophthalic acid, terephthalic acid, naphthalene-2,6-dicarboxylic acid, naphthalene-2,7-dicarboxylic acid, cyclohexane dicarboxylic acid, malonic acid, mesaconic acid, and a diester or anhydride thereof. The organic diacid may be selected in an amount of, for example, in embodiments from about 40 to about 60 mole %.

Examples of crystalline resins include polyesters, polyamides, polyimides, polyolefins, polyethylene, polybutylene, polyisobutyrate, ethylene-propylene copolymers, ethylene-vinyl acetate copolymers, polypropylene, mixtures thereof, and the like. Specific crystalline resins may be polyester based, such as poly(ethylene-adipate), poly(propylene-adipate), poly(butylene-adipate), poly(pentylene-adipate), poly(hexylene-adipate), poly(octylene-adipate), poly(ethylene-succinate), poly(propylene-succinate), poly(butylene-succinate), poly(pentylene-succinate), poly(hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate), poly(decylene-sebacate), poly(decylene-decanoate), poly(ethylene-decanoate), poly(ethylene dodecanoate), poly(hexane-dodecanoate), poly(nonylene-sebacate), poly(nonylene-decanoate), poly(nonane-dodecanoate), copoly(ethylene-fumarate)-copoly(ethylene-sebacate), copoly(ethylene-fumarate)-copoly(ethylene-decanoate), copoly(ethylene-fumarate)-copoly(ethylene-dodecanoate) and so on. Examples of polyamides include poly(ethylene-adipamide), poly(propylene-adipamide), poly(butylenes-adipamide), poly(pentylene-adipamide), poly(hexylene-adipamide), poly(octylene-adipamide), poly(ethylene-succinimide), and poly(propylene-sebecamide). Examples of polyimides include poly(ethylene-adipimide), poly(propylene-adipimide), poly(butylene-adipimide), poly(pentylene-adipimide), poly(hexylene-adipimide), poly(octylene-adipimide), poly (ethylene-succinimide), poly(propylene-succinimide), poly (butylene-succinimide), and mixtures thereof.

Suitable crystalline resins include those disclosed in U.S. Publ. No. 2006/0222991, the disclosure of which is hereby incorporated by reference in entirety. In embodiments, a suitable crystalline resin may be composed of ethylene glycol and a mixture of dodecanedioic acid and fumaric acid comonomers.

The crystalline resin may possess various melting points of, for example, from about 30° C. to about 120° C., in embodiments, from about 50° C. to about 90° C. The crystalline resin may have a number average molecular weight (Mn) as measured by gel permeation chromatography (GPC) of, for example, from about 1,000 to about 50,000, in embodiments, from about 2,000 to about 25,000, and a weight average molecular weight (Mw) of, for example, from about 2,000 to about 100,000, in embodiments, from about 3,000 to about 80,000, as determined by GPC. The molecular weight distribution (Mw/Mn) of the crystalline resin may be, for example, from about 2 to about 6, in embodiments, from about 3 to about 4. The crystalline polyester resins may have an acid value of less than about 1 meq KOH/g, from about 0.5 to about 0.65 meq KOH/g, in embodiments, from about 0.65 to about 0.75 meq KOH/g, from about 0.75 to about 0.8 meq KOH/g.

The crystalline polyester resin may be presented in an amount of from about 5 weight percent to 25 weight percent by weight of the toner.

Amorphous Resins

Examples of diacid or diesters selected for the preparation of amorphous polyesters include dicarboxylic acids or diesters selected from the group consisting of terephthalic acid, phthalic acid, isophthalic acid, fumaric acid, maleic acid, itaconic acid, succinic acid, succinic anhydride, dodecylsuccinic acid, dodecylsuccinic anhydride, glutaric acid, glutaric anhydride, adipic acid, pimelic acid, suberic acid, azelaic acid, dodecanediacid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate, and mixtures thereof. The organic diacid or diester is selected, for example, from about 45 to about 52 mole % of the resin.

Examples of diols utilized in generating the amorphous polyester include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis(hyroxyethyl)-bisphenol A, bis(2-hyroxypropyl)-bisphenol A, 1,4-cyclohexanedimethanol, 1,3-cyclohexanedimethanol, xylenedimethanol, cyclohexanediol, diethylene glycol, bis (2-hydroxyethyl) oxide, dipropylene glycol, dibutylene, 1,2-ethanediol, 1,5-pentanediol, 1,6-hexanediol, 1,7-heptanediol, 1,8-octanediol, 1,9-nonanediol, 1,10-decanediol, 1,12-dodecanediol, and the like; alkali sulfo-aliphatic diols, such as, sodio 2-sulfo-1,2-ethanediol, lithio 2-sulfo-1,2-ethanediol, potassio 2-sulfo-1,2-ethanediol, sodio 2-sulfo-1,3-propanediol, lithio 2-sulfo-1,3-propanediol, potassio 2-sulfo-1,3-propanediol, mixtures thereof, and the like, and mixtures thereof. The amount of organic diol selected may vary, and more specifically, is, for example, from about 45 to about 52 mole % of the resin.

Alkali sulfonated difunctional monomer examples, wherein the alkali is lithium, sodium, or potassium, include dimethyl-5-sulfo-isophthalate, dialkyl-5-sulfo-isophthalate-4-sulfo-1,8-naphthalic anhydride, 4-sulfo-phthalic acid, 4-sulfophenyl-3,5-dicarbomethoxybenzene, 6-sulfo-2-naphthyl-3,5-dicarbomethoxybenzene, sulfo-terephthalic acid, dimethyl-sulfo-terephthalate, dialkyl-sulfo-terephthalate, sulfo-ethanediol, 2-sulfo-propanediol, 2-sulfo-butanediol, 3-sulfo-pentanediol, 2-sulfo-hexanediol, 3-sulfo-2-methylpentanediol, N,N-bis(2-hydroxyethyl)-2-aminoethane sulfonate, 2-sulfo-3,3-dimethylpent-anediol, sulfo-p-hydroxybenzoic acid, mixtures thereto, and the like. Effective difunctional monomer amounts of, for example, from about 0.1 to about 2 wt % of the resin may be selected.

Exemplary amorphous polyester resins include, but are not limited to, propoxylated bisphenol A fumarate resin, poly(propoxylated bisphenol co-fumarate), poly(ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly(propoxylated bisphenol co-maleate), poly(ethoxylated bisphenol co-maleate), poly(butyloxylated bisphenol co-maleate), poly(co-propoxylated bisphenol co-ethoxylated bisphenol co-maleate), poly(1,2-propylene maleate), poly (propoxylated bisphenol co-itaconate), poly(ethoxylated bisphenol co-itaconate), poly(butyloxylated bisphenol co-itaconate), poly(co-propoxylated bisphenol co-ethoxylated bisphenol co-itaconate), poly(1,2-propylene itaconate), a copoly(propoxylated bisphenol A co-fumarate)-copoly (propoxylated bisphenol A co-terephthalate), a terpoly (propoxylated bisphenol A co-fumarate)-terpoly(propoxylated bisphenol A co-terephthalate)-terpoly-(propoxylated bisphenol A co-dodecylsuccinate), and mixtures thereof.

In embodiments, a suitable amorphous polyester resin may be a poly(propoxylated bisphenol A co-fumarate) resin. Examples of such resins and processes for their production include those disclosed in U.S. Pat. No. 6,063,827, the disclosure of which is hereby incorporated by reference in entirety.

An example of a linear propoxylated bisphenol A fumarate resin which may be utilized as a latex resin is available under the trade name SPARII from Resana S/A Industrias Quimicas, Sao Paulo Brazil.

In embodiments, a suitable amorphous resin utilized in a toner of the present disclosure may be a low molecular weight amorphous resin, sometimes referred to, in embodiments, as an oligomer, having an Mw of from about 500 daltons to about 10,000 daltons, in embodiments, from about 1000 daltons to about 5000 daltons, in embodiments, from about 1500 daltons to about 4000 daltons. The amorphous resin may possess a Tg of from about 58.5° C. to about 66° C., in embodiments, from about 60° C. to about 62° C. The low molecular weight amorphous resin may possess a softening point of from about 105° C. to about 118° C., in embodiments, from about 107° C. to about 109° C. The amorphous polyester resins may have an acid value of from about 8 to about 20 meq KOH/g, in embodiments, from about 10 to about 16 meq KOH/g, in embodiments, from about 11 to about 15 meq KOH/g.

In other embodiments, an amorphous resin utilized in forming a toner of the present disclosure may be a high molecular weight amorphous resin. As used herein, the high molecular weight amorphous polyester resin may have, for example, a number average molecular weight (Mn), as measured by GPC of, for example, from about 1,000 to about 10,000, in embodiments, from about 2,000 to about 9,000, in embodiments, from about 3,000 to about 8,000, in embodiments from about 6,000 to about 7,000. The weight average molecular weight (Mw) of the resin can be greater than 45,000, for example, from about 45,000 to about 150,000, in embodiments, from about 50,000 to about 100,000, in embodiments, from about 63,000 to about 94,000, in embodiments, from about 68,000 to about 85,000, as determined by GPC. The polydispersity index (PD), equivalent to the molecular weight distribution, is above about 4, such as, for example, in embodiments, from about 4 to about 20, in embodiments, from about 5 to about 10, in embodiments, from about 6 to about 8, as measured by GPC. The high molecular weight amorphous polyester resins, which are available from a number of sources, may possess various melting points of, for example, from about 30° C. to about 140° C., in embodiments, from about 75° C. to about 130° C., in embodiments, from about 100° C. to about 125° C., in embodiments, from about 115° C. to about 124° C. High molecular weight amorphous resins may possess a Tg of from about 53° C. to about 58° C., in embodiments, from about 54.5° C. to about 57° C.

The low molecular weight amorphous polyester resin may have an Mw of from about 10,000 to about 30,000, from about 15,000 to about 25,000.

In further embodiments, the combined amorphous resins may have a melt viscosity of from about 10 to about 1,000,000 Pa*S at about 130° C., in embodiments, from about 50 to about 100,000 Pa*S.

The total amorphous polyester resin may be presented in an amount of from about 20 weight percent to 60 weight percent by weight of the toner. The high molecular weight amorphous polyester resin may be presented in an amount of from about 20 weight percent to 50 weight percent by weight of the toner. The low molecular weight amorphous polyester resin may be presented in an amount of from about 10 weight percent to 50 weight percent by weight of the toner.

The toner composition of the present embodiments may or may not contain a cross-linked resin.

Catalyst

Polycondensation catalysts which may be utilized in forming either the crystalline or amorphous polyesters include tetraalkyl titanates, dialkyltin oxides, such as, dibutyltin oxide, tetraalkyltins, such as, dibutyltin dilaurate, and dialkyltin oxide hydroxides, such as, butyltin oxide hydroxide, aluminum alkoxides, alkyl zinc, dialkyl zinc, zinc oxide, stannous oxide, or combinations thereof. Such catalysts may be utilized in amounts of, for example, from about 0.01 mole % to about 5 mole %, based on the starting diacid or diester used to generate the polyester resin.

Crosslinking Resin

Linear or branched unsaturated polyesters can be converted into a highly crosslinked polyester by reactive extrusion. Linear or branched unsaturated polyesters may include both saturated and unsaturated diacids (or anhydrides) and dihydric alcohols (glycols or diols). The resulting unsaturated polyesters can be reactive (for example, crosslinkable) on two fronts: (i) unsaturation sites (double bonds) along the polyester chain, and (ii) functional groups, such as, carboxyl, hydroxy and similar groups amenable to acid-base reaction. Unsaturated polyester resins may be prepared by melt polycondensation or other polymerization processes using diacids and/or anhydrides and diols. Illustrative examples of unsaturated polyesters may include any of various polyesters, such as SPAR™ (Dixie Chemicals), BECKOSOL™ (Reichhold Inc), ARAKOTE™ (Ciba-Geigy Corporation), HETRON™ (Ashland Chemical), PARAPLEX™ (Rohm & Hass), POLYLITE™ (Reichhold Inc), PLASTHALL™ (Rohm & Hass), CYGAL™ (American Cyanamide), ARMCO™ (Armco Composites), ARPOL™ (Ashland Chemical), CELANEX™ (Celanese Eng), RYNITE™ (DuPont), STYPOL™ (Freeman Chemical Corporation), a linear unsaturated poly(propoxylated bisphenol A co-fumarate) polyester, XP777 (Reichhold Inc.), mixtures thereof and the like. The resins may also be functionalized, such as, carboxylated, sulfonated or the like, such as, sodio sulfonated.

The crosslinked resin may be prepared by (1) melting the linear or branched unsaturated polyester in a melt mixing device; (2) initiating cross-linking of the polymer melt, preferably with a chemical crosslinking initiator and increasing reaction temperature; (3) keeping the polymer melt in the melt mixing device for a sufficient residence time that partial cross-linking of the linear or branched resin may be achieved; (4) providing sufficiently high shear during the cross-linking reaction to keep the gel particles formed and broken down during shearing and mixing and well distributed in the polymer melt; (5) optionally devolatizing the polymer melt to remove any effluent volatiles; and (6) optionally adding additional linear or branched resin after the crosslinking in order to achieve the desired level of gel content in the end resin. As used herein, the term "gel" refers to the crosslinked domains within the polymer. Chemical initiators such as, for example, organic peroxides or azo-compounds may be used for making the crosslinked resin for the invention. In one embodiment, the initiator is 1,1-di(t-butyl peroxy)-3,3,5-trimethylcyclohexane.

In one embodiment, the highly crosslinked resin is prepared from an unsaturated poly(propoxylated bisphenol A co-fumarate) polyester resin.

Colorants

As examples of suitable colorants, mention may be made of carbon black like REGAL 330®; magnetites, such as, Mobay magnetites MO8029™ and MO8060™; Columbian magnetites; MAPICO BLACKS™, surface-treated magnetites; Pfizer magnetites CB4799™, CB5300™, CB5600™ and MCX6369™; Bayer magnetites, BAYFERROX8600™ and 8610™; Northern Pigments magnetites, NP-604™ and NP-608™; Magnox magnetites TMB-100™ or TMB-104™; and the like. As colored pigments, there can be selected cyan, magenta, yellow, red, green, brown, blue or mixtures thereof. Generally, cyan, magenta or yellow pigments or dyes, or mixtures thereof, are used. The pigment or pigments can be water-based pigment dispersions.

Specific examples of pigments include SUNSPERSE 6000, FLEXIVERSE and AQUATONE water-based pigment dispersions from SUN Chemicals, HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™ PIGMENT RED48™, LEMON CHROME YELLOW DCC1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, CINQUASIA MAGENTA™ available from E.I. DuPont de Nemours & Company and the like. Colorants that can be selected are black, cyan, magenta, yellow and mixtures thereof. Examples of magentas are 2,9-dimethyl-substituted quinacridone and anthraquinone dye identified in the Color Index as CI 60710, CI Dispersed Red 15, diazo dye identified in the Color Index as CI 26050, CI Solvent Red 19 and the like. Illustrative examples of cyans include copper tetra(octadecyl sulfonamido) phthalocyanine, x-copper phthalocyanine pigment listed in the Color Index as CI 74160, CI Pigment Blue, Pigment Blue 15:3, Anthrathrene Blue, identified in the Color Index as CI 69810, Special Blue X-2137 and the like. Illustrative examples of yellows are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide and Permanent Yellow FGL. Colored magnetites, such as, mixtures of MAPICO BLACK™, and cyan components also may be selected as colorants. Other known colorants can be selected, such as, Levanyl Black A-SF (Miles, Bayer) and Sunsperse Carbon Black LHD 9303 (Sun Chemicals), and colored dyes, such as, Neopen Blue (BASF), Sudan Blue OS (BASF), PV Fast Blue B2G01 (American Hoechst), Sunsperse Blue BHD 6000 (Sun Chemicals), Irgalite Blue BCA (Ciba-Geigy), Paliogen Blue 6470 (BASF), Sudan III (Matheson, Coleman, Bell), Sudan II (Matheson, Coleman, Bell), Sudan IV (Matheson, Coleman, Bell), Sudan Orange G (Aldrich), Sudan Orange 220 (BASF), Paliogen Orange 3040 (BASF), Ortho Orange OR 2673 (Paul Uhlich), Paliogen Yellow 152, 1560 (BASF), Lithol Fast Yellow 0991K (BASF), Paliotol Yellow 1840 (BASF), Neopen Yellow (BASF), Novoperm Yellow FG 1 (Hoechst), Permanent Yellow YE 0305 (Paul Uhlich), Lumogen Yellow D0790 (BASF), Sunsperse Yellow YHD 6001 (Sun Chemicals), Suco-Gelb L1250 (BASF), Suco-Yellow D1355 (BASF), Hostaperm Pink E (American Hoechst), Fanal Pink D4830 (BASF), Cinquasia Magenta (DuPont), Lithol Scarlet D3700 (BASF), Toluidine Red (Aldrich), Scarlet for Thermoplast NSD PS PA (Ugine Kuhlmann of Canada), E.D. Toluidine Red (Aldrich), Lithol Rubine Toner (Paul Uhlich), Lithol Scarlet 4440 (BASF), Bon Red C (Dominion Color Company), Royal Brilliant Red RD-8192 (Paul Uhlich), Oracet Pink RF (Ciba-Geigy), Paliogen Red 3871K (BASF), Paliogen Red 3340 (BASF), Lithol Fast Scarlet L4300 (BASF), combinations of the foregoing and the like.

Wax

In addition to the polymer resin, the toners of the present disclosure also may contain a wax, which can be either a single type of wax or a mixture of two or more different waxes. A single wax can be added to toner formulations, for example, to improve particular toner properties, such as, toner particle shape, presence and amount of wax on the toner particle surface, charging and/or fusing characteristics, gloss, stripping, offset properties and the like. Alternatively, a combination of waxes can be added to provide multiple properties to the toner composition. In embodiments, no wax is included in the toner composition of the present disclosure.

When included, the wax may be present in an amount of, for example, from about 1 wt % to about 25 wt % of the toner particles, in embodiments, from about 5 wt % to about 20 wt % of the toner particles.

Waxes that may be selected include waxes having, for example, a weight average molecular weight of from about 500 to about 20,000, in embodiments from about 1,000 to about 10,000. Waxes that may be used include, for example, polyolefins, such as, polyethylene, polypropylene and polybutene waxes, such as, commercially available from Allied Chemical and Petrolite Corporation, for example POLYWAX™ polyethylene waxes from Baker Petrolite, wax emulsions available from Michaelman, Inc. and the Daniels Products Company, EPOLENE N-15™ commercially available from Eastman Chemical Products, Inc., and VISCOL 550-P™, a low weight average molecular weight polypropylene available from Sanyo Kasei K. K.; plant-based waxes, such as, carnauba wax, rice wax, candelilla wax, sumacs wax and jojoba oil; animal-based waxes, such as, beeswax; mineral-based waxes and petroleum-based waxes, such as, montan wax, ozokerite, ceresin, paraffin wax, microcrystalline wax and Fischer-Tropsch wax; ester waxes obtained from higher fatty acid and higher alcohol, such as, stearyl stearate and behenyl behenate; ester waxes obtained from higher fatty acid and monovalent or multivalent lower alcohol, such as, butyl stearate, propyl oleate, glyceride monostearate, glyceride distearate, pentaerythritol tetra behenate; ester waxes obtained from higher fatty acid and multivalent alcohol multimers, such as, diethyleneglycol monostearate, dipropyleneglycol distearate, diglyceryl distearate and triglyceryl tetrastearate; sorbitan higher fatty acid ester waxes, such as, sorbitan monostearate, and cholesterol higher fatty acid ester waxes, such as, cholesteryl stearate. Examples of functionalized waxes that may be used include, for example, amines, amides, for example, AQUA SUPERSLIP6550™ and SUPERSLIP 6530™ available from Micro Powder Inc., fluorinated waxes, for example, POLYFLUO 190™ POLYFLUO 200™, POLYSILK19™ and POLYSILK14™ available from Micro Powder Inc., mixed fluorinated, amide waxes, for example, MICROSPERSION19™ available from Micro Powder Inc., imides, esters, quaternary amines, carboxylic acids or acrylic polymer emulsion, for example JONCRYL 74™ 89™ 130™, 537™ and 538™ all available from SC Johnson Wax, and chlorinated polypropylenes and polyethylenes available from Allied Chemical and Petrolite Corporation and SC Johnson wax. Mixtures and combinations of the foregoing waxes also may be used in embodiments. Waxes may be included as, for example, fuser roll release agents.

Surface Additives

The toner composition of the present embodiments may include one or more surface additives. The surface additives are coated onto the surface of the toner particles, which may provide a total surface area coverage of from about 50% to about 99%, from about 60% to about 90%, or from about 70% to about 80% of the toner particle. The toner composition of the present embodiment may include from about 2.7% to about 4.0%, from about 3.0% to about 3.7%, or from about 3.1% to about 3.5% of surface additive based on the total weight on the toner.

The surface additives may include silica, titania and stearates. The charging and flow characteristics of a toner are influenced by the selection of surface additives and concentration of such in the toner. The concentration of surface additives and their size and shape control the arrangement of these on the toner particle surface. In embodiments, the silica includes two coated silicas. More specifically, one of the two silicas may be a negative charging silica, and the other silica may be a positive charging silica (relative to the carrier). By negatively charging is meant that the additive is negatively charging relative to the toner surface measured by determining the toner triboelectric charge with and without the additive. Similarly, by positively charging is meant that the additives are positively charging relative to the toner surface measured by determining the toner triboelectric charge with and without the additive.

An example of the negative charging silica include NA50HS obtained from DeGussa/Nippon Aerosil Corporation, which is a fumed silica coated with a mixture of hexamethyldisilazane and aminopropyltriethoxysilane (having approximately 30 nanometers of primary particle size and about 350 nanometers of aggregate size).

An example of the relatively positive charging silica include H2050 silica with polydimethylsiloxane units or segments, and having amino/ammonium functions chemically bonded onto the surface of highly hydrophobic fumed silica, and which coated silica possesses a BET surface area of about 110 to about ±20 $m_2/g$ (obtained from Wacker Chemie).

The negative charging silica may be present in an amount from about 1.6% to about 2.4%, from about 1.8% to about 2.2%, from about 1.9% to about 2.1%, by weight of the surface additives.

The positive charging silica may be present in an amount from about 0.08% to about 1.2%, from about 0.09% to about 0.11%, from about 0.09% to about 0.1%, by weight of the surface additives.

The ratio of the negatively charging silica to the positively charging silica ranges from, for example, about 13:1 to about 30:1, or from about 15:1 to about 25:1, weight basis.

The surface additives may also include a titania. The titania may be present in an amount from about 0.53% to about 0.9%, from about 0.68% to about 0.83%, from about 0.7% to about 0.8%, by weight of the surface additives. A suitable titania for use herein is, for example, SMT5103 available from Tayca Corp., a titania having a size of about 25 to about 55 nm treated with decylsilane.

The weight ratio of the negative charging silica to the titania is from about 1.8:1 to about 4.5:1, from about 2.2:1 to about 3.2:1, or from about 2.5:1 to about 3.0:1.

The surface additives may also include a lubricant and conductivity aid, for example a metal salt of a fatty acid such as, e.g., zinc stearate, calcium stearate. A suitable example includes Zinc Stearate L from Ferro Corp., or calcium stearate from Ferro Corp. Such a conductivity aid may be present in an amount from about 0.10% to about 1.00% by weight of the toner.

In another embodiment, the toner and/or surface additive also include a conductivity aid, for example a metal salt of a fatty acid such as, e.g., zinc stearate. A suitable example includes Zinc Stearate L from Ferro Corp. Such a conductivity aid may be present in an amount from about 0.10% to about 1.00% by weight of the toner.

The white toner compositions of the present embodiments can be prepared by mixing, for example, melt mixing, and heating resin particles in a toner extrusion device, such as the ZSK25 available from Werner Pfleiderer, and removing the formed toner composition from the device. Subsequent to cooling, the toner composition is subjected to grinding utilizing, for example, a Sturtevant micronizer, reference U.S. Pat. No. 5,716,751, the disclosure of which is totally incorporated herein by reference. Subsequently, the toner compositions can be classified utilizing, for example, a Donaldson Model B classifier for the purpose of removing fines, that is, the particles are accompanied by very low levels of fine particles of the same material. For example, the levels of fine particles is in the range of from about 0.1% to about 3% by weight of the toner. After removing the excess fines content, the white toner may have a mean particle size of from about 5 microns to about 20 microns, from about 6 microns to about abut 10 microns, or from about 7 microns to about abut 9.5 microns. The GSD refers to the upper geometric standard deviation (GSD) by volume (coarse level) for (D84/D50) and can be from about 1.10 to about 1.30, or from about 1.15 to about 1.25, or from about 1.21 to about 1.27. The geometric standard deviation (GSD) by number (fines level) for (D50/D16) can be from about 1.10 to about 1.60, or from about 1.20 to about 1.40, or from about 1.26 to about 1.30. The particle diameters at which a cumulative percentage of 50% of the total toner particles are attained are defined as volume D50, and the particle diameters at which a cumulative percentage of 84% are attained are defined as volume D84. These aforementioned volume average particle size distribution indexes GSDv can be expressed by using D50 and D84 in cumulative distribution, wherein the volume average particle size distribution index GSDv is expressed as (volume D84/volume D50). These aforementioned number average particle size distribution indexes GSDn can be expressed by using D50 and D16 in cumulative distribution, wherein the number average particle size distribution index GSDn is expressed as (number D50/number D16). The closer to 1.0 that the GSD value is, the less size dispersion there is among the particles. The aforementioned GSD value for the toner particles indicates that the toner particles are made to have a narrow particle size distribution. The particle diameters are determined by a Multisizer III.

Thereafter, the surface additive mixture and other additives are added by the blending thereof with the toner obtained. The term "particle size," as used herein, or the term "size" as employed herein in reference to the term "particles," means volume weighted diameter as measured by conventional diameter measuring devices, such as a Multisizer III, sold by Coulter, Inc. Mean volume weighted diameter is the sum of the mass of each particle times the diameter of a spherical particle of equal mass and density, divided by total particle mass.

The size distribution and additive formulation of the toner is such that it enables the toner to be operated in a system providing offset lithography at a very low mass target while still providing sufficient coverage of the substrate. In this context, the mass target refers to concentration of toner particles that are developed or laid on the substrate (i.e. paper or other) per unit area of substrate. The size distribution and additive formulation of the toner is such that it enables the system to operate at a mass target of 0.3 to 0.4 mg of toner per square centimeter of substrate.

The average circularity of the toner particles is from about 0.920 to about 0.980, from about 0.930 to about 0.975, or from about 0.940 to about 0.970. The toners described herein exhibit surprisingly desirable fusing properties even with high loading of colorants. Typically, it is challenging for toners having high colorant loading (e.g., >30 weight % based on total weight of the toner) to achieve good fusing properties. Good fusing properties refer to achieving scratch resistance and crease fracturing resistance. Typically, the minimum fusing temperature of 180° C. is required when the toner adheres well to the substrate.

Toners of the present disclosure may possess a parent toner charge per mass ratio (Q/M) in ambient conditions (B-zone) of about 21° C./50% RH of from about 15 ρC/g to about 50 μC/g, in embodiments from about 18 μC/g to about 40 μC/g, or from about 20 μC/g to about 35 μC/g.

The toners of the present disclosure may exhibit a dynamic viscosity η' in the temperature range between 100° C. to 180° C. at 5% strain at 6.28 rad/sec from about 10000 Pa·s to about 10 Pa·s, from about 5000 Pa·s to about 90 Pa·s, or from about 4000 Pa·s to about 150 Pa·s.

Toner Preparation

The toner particles may be made by any known emulsion/aggregation process. Emulsion/aggregation/coalescing processes for the preparation of toners are illustrated in a number of Xerox patents, the disclosures of which are totally incorporated herein by reference, such as U.S. Pat. Nos. 5,290,654, 5,278,020, 5,308,734, 5,370,963, 5,344,738, 5,403,693, 5,418,108, 5,364,729, and 5,346,797. Also of interest may be U.S. Pat. Nos. 5,348,832, 5,405,728, 5,366,841, 5,496,676, 5,527,658, 5,585,215, 5,650,255, 5,650,256 and 5,501,935 (spherical toners).

Toner compositions and toner particles of the present disclosure may be prepared by aggregation and coalescence processes in which smaller-sized resin particles are aggregated to the appropriate toner particle size and then coalesced to achieve the final toner particle shape and morphology.

The process of preparing EA particles may involve generating an emulsion mixture including the resins described above, optionally with surfactants, optionally with wax, and optionally with surface additives. The emulsion of polyester resin may be generated by dispersing the resin in an aqueous medium by any suitable means. The colorant may be subsequently incorporated into the emulsion as a dry powder. Alternately, the colorant may be subsequently incorporated into the emulsion mixture as an aqueous colorant dispersion (e.g., the colorant is separately dispersed in an aqueous surfactant solution, optionally with additional resin, before adding to the emulsion mixture).

Examples of surfactants that can be used in the aqueous surfactant solution include, anionic surfactants, such as, diphenyl oxide disulfonate, ammonium lauryl sulfate, sodium dodecyl benzene sulfonate, dodecyl benzene sulfonic acid, sodium alkyl naphthalene sulfonate, sodium dialkyl sulfosuccinate, sodium alkyl diphenyl ether disulfonate, potassium salt of alkylphosphate, sodium polyoxyethylene lauryl ether sulfate, sodium polyoxyethylene alkyl ether sulfate, sodium polyoxyethylene alkyl ether sulfate, triethanolamine polyoxyethylene alkylether sulfate, sodium naphthalene sulfate, and sodium naphthalene sulfonate formaldehyde condensate, and mixtures thereof; and nonionic surfactants, such as, polyvinyl alcohol, methyl cellulose, ethyl cellulose, propyl cellulose, hydroxy ethyl cellulose, carboxy methylcellulose, polyoxyethylene cetyl ether, polyoxyethylene lauryl ether, polyoxyethylene octyl ether, polyoxyethylene nonylphenyl ether, polyoxyethylene oleyl ether, polyoxyethylene sorbitan monolaurate, polyoxyethylene stearyl ether, dialkylphenoxy poly(ethyleneoxy)ethanol, and mixtures thereof.

The pH of the resulting mixture may be adjusted by an acid (i.e., a pH adjustor) such as, for example, acetic acid, nitric acid or the like. In embodiments, the pH of the mixture may be adjusted to from about 2 to about 4.5. Additionally, in embodiments, the mixture may be homogenized. If the mixture is homogenized, homogenization may be accomplished by mixing at about 600 to about 4,000 revolutions per minute (rpm). Homogenization may be accomplished by any suitable means, including, for example, with an IKA ULTRA TURRAX T50 probe homogenizer or a Gaulin 15MR homgenizer.

Following preparation of the above mixture, generally, an aggregating agent may be added to the mixture. Examples of suitable aggregating agents include polyaluminum halides such as polyaluminum chloride (PAC), or the corresponding bromide, fluoride, or iodide, polyaluminum silicates such as polyaluminum sulfo silicate (PASS), and water soluble metal salts including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, combinations thereof, and the like. In embodiments, suitable aggregating agents include a polymetal salt such as, for example, polyaluminum chloride (PAC), polyaluminum bromide, or polyaluminum sulfosilicate.

The aggregating agent may be added to the mixture to form a toner in an amount of, for example, from about 0.1 parts per hundred (pph) to about 1 pph of the toner particles, in embodiments, from about 0.25 pph to about 0.75 pph of the toner particles. In embodiments, the aggregating agent is present in the toner composition in an amount of from about 0.1 to about 1.0 percent, or of from about 0.2 to about 0.8 percent, or of from about 0.25 to about 0.5 percent by weight of the total weight of the toner particles. In embodiments, the aggregating agent may be added to the mixture at a temperature that is below the glass transition temperature (Tg) of the resin.

To control aggregation and coalescence of the particles, in embodiments, the aggregating agent may be metered into the mixture over time. For example, the agent may be metered into the mixture over a period of from about 5 to about 240 min, in embodiments, from about 30 to about 200 min. Addition of the agent may also be done while the mixture is maintained under stirred conditions, in embodiments from about 50 rpm to about 1,000 rpm, in embodiments, from about 100 rpm to about 500 rpm, and at a temperature that is below the Tg of the resin.

The particles may be permitted to aggregate until a predetermined desired particle size is obtained. A predetermined desired size refers to the desired particle size as determined prior to formation, with particle size monitored during the growth process as known in the art until such particle size is achieved. Samples may be taken during the growth process and analyzed, for example with a Coulter Counter, for average particle size. The aggregation thus may proceed by maintaining the elevated temperature, or slowly raising the temperature to, for example, from about 40° C. to about 65° C., and holding the mixture at that temperature for a time from about 0.5 hour to about 6 hour, in embodiments, from about 1 hour to about 5 hour, while maintaining stirring, to provide the aggregated particles. Once the predetermined desired particle size is obtained, the growth process is halted. In embodiments, the predetermined desired particle size is within the toner particle size ranges mentioned above. In embodiments, the particle size may be about 5.0 to about 20.0 μm, about 6.0 to about 15.0 μm, about 6.0 to about 10.0 μm, about 7.0 to about 9.5 μm.

Growth and shaping of the particles following addition of the aggregation agent may be accomplished under any suitable conditions. For example, the growth and shaping may be conducted under conditions in which aggregation occurs separate from coalescence. For separate aggregation and coalescence stages, the aggregation process may be conducted under shearing conditions at an elevated temperature, for example from about 40° C. to about 70° C., in embodiments, from about 40° C. to about 60° C., which may be below the Tg of the resin.

Following aggregation to the desired particle size, with the optional formation of a shell as described above, the particles then may be coalesced to the desired final shape, for batch or conventional method, the coalescence being achieved by, for example, heating the mixture to a temperature of from about 65° C. to about 95° C., in embodiments from about 70° C. to about 90° C., which may be below the melting point of a crystalline resin to prevent plasticization. Higher or lower temperatures may be used, it being understood that the temperature is a function of the resins used.

Coalescence may proceed over a period of from about 0.1 to about 9 hour, in embodiments, from about 0.5 to about 4 hour.

In continuous process, the coalescence temperature range can be from about 70° C. to about 120° C., in embodiments from about 80° C. to about 110° C., in embodiments from about 90° C. to about 105° C. and coalescence time may be from about 10 seconds to 10 minutes, including from about 10 seconds to about 10 minutes, or from about 15 seconds to 5 minutes or from about 30 seconds to 2 minutes.

After coalescence, the mixture may be cooled to room temperature, such as from about 20° C. to about 25° C. The cooling may be rapid or slow, as desired. A suitable cooling method may include introducing cold water to a jacket around the reactor. After cooling, the toner particles optionally may be washed with water and then dried. Drying may be accomplished by any suitable method, for example, freeze drying.

The following Examples are being submitted to illustrate embodiments of the present disclosure. These Examples are intended to be illustrative only and are not intended to limit the scope of the present disclosure. Also, parts and percentages are by weight unless otherwise indicated. As used herein, "room temperature" refers to a temperature of from about 20° C. to about 25° C.

EXAMPLES

Comparative Examples 1-3

White Conventional Toners: Comparative Example 1 (20 wt % of $TiO_2$), Comparative Example 2 (30 wt % of $TiO_2$), and Comparative Example 3 (40 wt % of $TiO_2$), Production of white parent particles started by extruding the raw materials in a ZSK-25 extruder. The mixture consisted of various levels of a Propoxylated Bisphenol-A/Fumaric Acid resin with weight average molecular weight (MW) of around 13,000 pse and 20 wt % of a gel resin was made by crosslinking the Propoxylated Bisphenol-A/Fumaric Acid resin. Various levels of white pigment were used: 20 wt % of $TiO_2$ (Comparative Example 1), 30 wt % of $TiO_2$ (Comparative Example 2), and 40 wt % of $TiO_2$ (Comparative Example 3). The pigment used was a treated $TiO_2$ such as R-706 from E.I. duPont. This $TiO_2$ pigment has a mean size of around 300 nm and has a silica and alumina treatment that enables better dispersion in an organic phase. The resulting extrudates were pulverized in a 200 AFG fluid bed jet mill to a target median size of 7.6 microns. The target particle size was selected to enable a mean size of around 8.3 microns after removing the excess fines content. 0.3% silica (CABOSIL® TS530) was added during the pulverization process as a flow aid. The particles were classified in a B18 Tandem Acucut system.

Disclosure Examples: 4-10

A series of white polyester EA particles (see Table 1) were prepared at different $TiO_2$ loadings ranging from 40 weight percent up to 55 weight percent. Table 1 summaries the formulation (particularly, $TiO_2$ content) and the physical characterizations of the toners, and do not limit the scope of the present disclosure. EA toner Example 1 was prepared by an early version batch aggregation with continuous coalescence process. EA toners Examples 2-6 were prepared by a full batch process. EA toners Examples 7-9 were prepared by batch aggregation and continuous coalescence. EA toner Examples 1-9 were prepared at laboratory scale. EA toner Example 10 was prepared at the 20 gallon scale with fully batch aggregation and coalescences.

TABLE 1

| Examples | $TiO_2$ Grade | $TiO_2$ Input Loading (wt. %) | Particle Size $d_{50}$ (um) | GSD v/n | Circularity | TGA (Residual wt %) |
|---|---|---|---|---|---|---|
| Montreal White Conventional | R706 | 25 | 8.15 | 1.27/1.59 | 0.931 | NA |
| Example 1 | R900 | 40 | 6.83 | 1.23/1.27 | 0.948 | 35.81 |
| Example 2 | R900 | 40 | 7.82 | 1.23/1.30 | 0.954 | 38.87 |
| Example 3 | R900 | 50 | 8.41 | 1.25/1.27 | 0.953 | NA |
| Example 4 | R706 | 50 | 9.24 | 1.27/1.26 | 0.949 | 48.74 |
| Example 5 | R900 | 50 | 9.05 | 1.23/1.30 | 0.947 | 49.17 |
| Example 6 | R900 | 40 | 8.59 | 1.21/1.30 | 0.953 | 38.94 |
| Example 7 | R900 | 50 | 8.10 | 1.26/1.28 | 0.968 | 48.52 |
| Example 8 | R900 | 50 | 7.92 | 1.27/1.28 | 0.962 | 48.30 |
| Example 9 | R900 | 40 | 8.10 | 1.24/1.30 | 0.960 | 48.30 |
| Example 10 | R900 | 45 | 7.92 | 1.27/1.40 | 0.947 | NA |

Example 1

This EA toner was prepared using a batch aggregation continuous coalescence process.

Into a two liter plastic container was added 200 g of dry $TiO_2$ R900, 13.33 g of Calfax, and 1005.77 g of water. The pigment used was a rutile titanium dioxide pigment, such as Ti-Pure® R-900 available from E.I. duPont. This solution was then put under a homogenizer at 3000 rpm, and samples were tested with the Nanotrac to determine when the pigment particles were dispersed down to the primary particle size. Into a four liter plastic container was added the 1211.765 g of well mixed pigment dispersion, 410.682 g of low Mw polyester amorphous resin dispersion (poly (propoxylated-bisphenol A—terephthalate-dodencylsuccinic anhydride), 39.76 wt %), and 1063.827 g of water. This mixture was then pH adjusted to 4.2 using 67.4 g of 0.3M $HNO_3$ acid. Separately, a solution of 8.977 g $Al_2(SO_4)_3$ (27.85 wt %) and 110.712 g of water was added in as a flocculent under homogenization at 3500 rpm. The mixture was then added into a four liter stainless steel reactor equipped with an overhead mixer, and stirred at 200 rpm as the mixture was heated to 48° C. When the temperature of the mixture reached steady state, the rpm was increased to 400 and particle size was monitored with a Coulter Counter until the core particles reached a volume average particle size of 4.884 μm, a GSD volume of 1.220, and a GSD number of 1.430. A shell material containing 359.346 g of the above mentioned poly(propoxylated-bisphenol A—terephthalate-dodencylsuccinic anhydride) resin dispersions and 200.654 g of water was pH adjusted to 3.3 using 44.8 g of 0.3M $HNO_3$ and added to the reaction slurry as the rpm of the overhead mixer was gradually decreased to 220. This resulted in a core-shell structured particle with an average size of 6.898 μm, a GSD volume of 1.213, and a GSD number of 1.266. Thereafter, the rpm of the overhead mixer was decreased to 70 and the pH of the reaction slurry was increased to 8.2 using a solution consisting of 57.692 g of the chelating agent Veresene100, and 346.154 g of water to freeze the toner particles growth. 49.0 g of 0.3M $HNO_3$ was used to maintain pH 8.2 during this step. Once the toner particles were frozen, 44.44 g of Calfax was added to the reaction slurry. The rpm was then increased to 160 and the reaction slurry was heated to 85° C., with 26.6 g of 4 wt % NaOH needed to maintain pH at 8.2 for coalescence. The particles were left mixing at this temperature until the measured circularity was found to be 0.948. The toner was then quenched in ice water to stop coalescence, resulting in a final average particle size of 6.825 μm, GSD volume of 1.233, GSD number of 1.259, and a circularity of 0.948. The toner slurry was then cooled to room temperature, separated by sieving (25 μm), filtration, followed by washing and freeze dried.

Example 2

This EA toner was prepared using a batch process.

Into a two liter plastic container was added 200 g of dry $TiO_2$ R900, 13.33 g of Calfax, and 1005.77 g of water. This solution was then put under a homogenizer at 3000 rpm, and samples were tested with the Nanotrac to determine when the pigment particles were dispersed down to the primary particle size. Into a four liter plastic container was added the 1211.765 g of well mixed pigment dispersion, along with 159.735 g of high molecular weight amorphous polyester resin dispersion (copoly(propoxylated/ethoxylated bisphenol A-terephthalate-dodecenylsuccinic anhydride-trimellitic anhydride), 40.25 wt %), 161.706 g of low molecular weight polyester amorphous resin dispersion (poly(propoxylated-bisphenol A—terephthalate-dodencylsuccinic anhydride resin), 39.76 wt %), 110.505 g of crystalline polyester resin dispersion (poly(nonane-dodecanoate), 31.40 wt %), and 1057.855 g of water. This mixture was then pH adjusted to 4.2 using 52.10 g of 0.3M $HNO_3$ acid. Separately, a solution of 8.977 g $Al_2(SO_4)_3$ (27.85 wt %) and 110.712 g of water was added in as a flocculent under homogenization at 3500 rpm. The mixture was then added into a four liter stainless steel reactor equipped with an overhead mixer, and stirred at 200 rpm as the mixture was heated to 48° C. When the temperature of the mixture reached steady state, the rpm was increased to 400 and particle size was monitored with a Coulter Counter until the core particles reached a volume average particle size of 5.316 μm, a GSD volume of 1.233, and a GSD number of 1.419. A shell material containing 177.483 g and 179.673 g of the above mentioned high molecular weight and low molecular weight resin dispersions and 202.844 g of water was pH adjusted to 3.3 using 45.02 g of 0.3M $HNO_3$ and added to the reaction slurry as the rpm of the overhead mixer was gradually decreased to 220. This resulted in a core-shell structured particle with an average size of 7.579 μm, a GSD volume of 1.226, and a GSD number of 1.272. Thereafter, the rpm of the overhead mixer was decreased to 70 and the pH of the reaction slurry was increased to 8.2 using a solution consisting of 57.692 g of the chelating agent Veresene100, and 346.154 g of water to freeze the toner particles growth. 71.7 g of 0.3M $HNO_3$ was used to maintain pH 8.2 during this step. Once the toner particles were frozen, 11.1 g of Calfax was added to the reaction slurry. The rpm was then increased to 160 and the reaction slurry was heated to 85° C., with 16.3 g of 4 wt % NaOH needed to maintain pH at 8.2 for coalescence. The particles were left mixing at this temperature until the measured circularity was found to be 0.950. The toner was then quenched in ice water to stop coalescence, resulting in a final average particle size of 7.82 μm, GSD volume of 1.246, GSD number of 1.279, and a circularity of 0.954. The toner slurry was then cooled to room temperature, separated by sieving (25 μm), filtration, followed by washing and freeze dried.

Example 3

This EA toner was prepared using a batch process.

Into a two liter plastic container was added 250 g of dry $TiO_2$ R900, 16.67 g of Calfax, and 1257.21 g of water. This solution was then put under a homogenizer at 3000 rpm, and samples were tested with the Nanotrac to determine when the pigment particles were dispersed down to the primary particle size. Into a four liter plastic container was added the 1514.71 g of well mixed pigment dispersion, along with 96.348 g of high molecular weight amorphous polyester resin dispersion (copoly(propoxylated/ethoxylated bisphenol A-terephthalate-dodecenylsuccinic anhydride-trimellitic anhydride), 40.25 wt %), 97.537 g of low molecular weight polyester amorphous resin dispersion (poly(propoxylated-bisphenol A—terephthalate-dodencylsuccinic anhydride) 39.76 wt %), 110.505 g of crystalline resin dispersion (poly(nonane-dodecanoate), 31.40 wt %), and 1109.159 g of water. This mixture was then pH adjusted to 4.2 using 68.8 g of 0.3M $HNO_3$ acid. Separately, a solution of 8.977 g $Al_2(SO_4)_3$ (27.85 wt %) and 110.712 g of water was added in as a flocculent under homogenization at 3500 rpm. The mixture was then added into a four liter stainless steel reactor equipped with an overhead mixer, and stirred at 200 rpm as the mixture was heated to 48° C. When the temperature of the mixture reached steady state, the rpm was increased to 400 and particle size was monitored with a Coulter Counter until the core particles reached a volume average particle size of 6.148 μm, a GSD volume of 1.233, and a GSD number of 1.539. A shell material containing 177.483 g and 179.673 g of the above mentioned high molecular weight and low molecular weight resin dispersions and 202.844 g of water was pH adjusted to 3.3 using 43.9 g of 0.3M $HNO_3$ and added to the reaction slurry as the rpm of the overhead mixer was gradually decreased to 220. This resulted in a core-shell structured particle with an average size of 8.069 μm, a GSD volume of 1.207, and a GSD number of 1.286. Thereafter, the rpm of the overhead mixer was decreased to 70 and the pH of the reaction slurry was increased to 8.2 using a solution consisting of 57.692 g of the chelating agent Veresene100, and 346.154 g of water to freeze the toner particles growth. 71.7 g of 0.3M $HNO_3$ was used to maintain pH 8.2 during this step. Once the toner particles were frozen, 11.1 g of Calfax was added to the reaction slurry. The rpm was then increased to 160 and the reaction slurry was heated to 85° C., with 16.3 g of 4 wt % NaOH needed to maintain pH at 8.2 for coalescence. The particles were left mixing at this temperature until the measured circularity was found to be 0.949. The toner was then quenched in ice water to stop coalescence, resulting in a final average particle size of 8.415 μm, GSD volume of 1.233, GSD number of 1.252, and a circularity of 0.953. The toner slurry was then cooled to room temperature, separated by sieving (25 μm), filtration, followed by washing and freeze dried.

Example 4

This EA toner was prepared using a batch process.

Into a two liter plastic container was added 250 g of dry TiO2 R900, 16.67 g of Calfax, and 1257.21 g of water. This solution was then put under a homogenizer at 3000 rpm, and samples were tested with the Nanotrac to determine when the pigment particles were dispersed down to the primary particle size. Into a four liter plastic container was added the 1514.71 g of well mixed pigment dispersion, along with 96.348 g of high molecular weight amorphous polyester resin dispersion (copoly(propoxylated/ethoxylated bisphenol A-terephthalate-dodecenylsuccinic anhydride-trimellitic anhydride), 40.25 wt %), 97.537 g of low molecular weight polyester amorphous resin dispersion (poly(propoxylated-bisphenol A—terephthalate-dodencylsuccinic anhydride), 39.76 wt %), 110.505 g of crystalline resin dispersion (poly(nonane-dodecanoate), 31.40 wt %), and 1111.859 g of water. This mixture was then pH adjusted to 4.2 using 66.1 g of 0.3M $HNO_3$ acid. Separately, a solution of 8.977 g $Al_2(SO_4)_3$ (27.85 wt %) and 110.712 g of water was added in as a flocculent under homogenization at 3500 rpm. The mixture was then added into a four liter stainless steel reactor equipped with an overhead mixer, and stirred at 200 rpm as the mixture was heated to 48° C. When the temperature of the mixture reached steady state, the rpm was increased to 400 and particle size was monitored with a Coulter Counter until the core particles reached a volume average particle size of 6.084 μm, a GSD volume of 1.259, and a GSD number of 1.935. A shell material containing 177.483 g and 179.673 g of the above mentioned high molecular weight and low molecular weight resin dispersions and 202.844 g of water was pH adjusted to 3.3 using 46.9 g of 0.3M $HNO_3$ and added to the reaction slurry as the rpm of the overhead mixer was gradually decreased to 220. This resulted in a core-shell structured particle with an average size of 8.155 μm, a GSD volume of 1.207, and a GSD number of 1.266. Thereafter, the rpm of the overhead mixer was decreased to 70 and the pH of the reaction slurry was increased to 8.2 using a solution consisting of 57.692 g of the chelating agent Veresene100, and 346.154 g of water to freeze the toner particles growth. 80.0 g of 0.3M $HNO_3$ was used to maintain pH 8.2 during this step. Once the toner particles were frozen, 11.1 g of Calfax was added to the reaction slurry. The rpm was then increased to 160 and the reaction slurry was heated to 85° C., with 24.2 g of 4 wt % NaOH needed to maintain pH at 8.2 for coalescence. The particles were left mixing at this temperature until the measured circularity was found to be 0.949. The toner was then quenched in ice water to stop coalescence, resulting in a final average particle size of 9.245 μm, GSD volume of 1.272, GSD number of 1.272, and a circularity of 0.949. The toner slurry was then cooled to room temperature, separated by sieving (25 μm), filtration, followed by washing and freeze dried.

Example 5

This EA toner was prepared using a batch process.

Into a two liter plastic container was added 250 g of dry TiO2 R900, 16.67 g of Calfax, and 1257.21 g of water. This solution was then put under a homogenizer at 3000 rpm, and samples were tested with the Nanotrac to determine when the pigment particles were dispersed down to the primary particle size. Into a four liter plastic container was added the 1514.71 g of well mixed pigment dispersion, along with 147.057 g of high molecular weight amorphous polyester resin dispersion (copoly(propoxylated/ethoxylated bisphenol A-terephthalate-dodecenylsuccinic anhydride-trimellitic anhydride), 40.25 wt %), 148.872 g of low polyester amorphous resin dispersion (poly(propoxylated-bisphenol A—terephthalate-dodencylsuccinic anhydride), 39.76 wt %), 110.505 g of crystalline resin dispersion (poly(nonane-dodecanoate), 31.40 wt %), and 1341.093 g of water. This mixture was then pH adjusted to 4.2 using 75.0 g of 0.3M $HNO_3$ acid. Separately, a solution of 8.977 g $Al_2(SO_4)_3$ (27.85 wt %) and 110.712 g of water was added in as a flocculent under homogenization at 3500 rpm. The mixture was then added into a four liter stainless steel reactor equipped with an overhead mixer, and stirred at 200 rpm as the mixture was heated to 48° C. When the temperature of the mixture reached steady state, the rpm was increased to 400 and particle size was monitored with a Coulter Counter until the core particles reached a volume average particle size of 7.192 μm, a GSD volume of 1.246, and a GSD number of 1.743. A shell material containing 126.774 g and 128.338 g of the above mentioned high molecular weight and low molecular weight resin dispersions and 144.888 g of water was pH adjusted to 3.3 using 32.80 g of 0.3M $HNO_3$ and added to the reaction slurry as the rpm of the overhead mixer was gradually decreased to 220. This resulted in a core-shell structured particle with an average size of 8.503 μm, a GSD volume of 1.220, and a GSD number of 1.383. Thereafter, the rpm of the overhead mixer was decreased to 70 and the pH of the reaction slurry was increased to 8.2 using a solution consisting of 57.692 g of the chelating agent Veresene100, and 346.154 g of water to freeze the toner particles growth. 77.1 g of 0.3M $HNO_3$ was used to maintain pH 8.2 during this step. Once the toner particles were frozen, 11.1 g of Calfax was added to the reaction slurry. The rpm was then increased to 160 and the reaction slurry was heated to 85° C., with 23.9 g of 4 wt % NaOH needed to maintain pH at 8.2 for coalescence. The particles were left mixing at this temperature until the measured circularity was found to be 0.947. The toner was then quenched in ice water to stop coalescence, resulting in a final average particle size of 9.054 μm, GSD volume of 1.233, GSD number of 1.299, and a circularity of 0.947. The toner slurry was then cooled to room temperature, separated by sieving (25 μm), filtration, followed by washing and freeze dried.

Example 6

This EA toner was prepared using a batch process.

Into a two liter plastic container was added 200 g of dry $TiO_2$ R900, 13.33 g of Calfax, and 1005.765 g of water. This solution was then put under a homogenizer at 3000 rpm, and samples were tested with the Nanotrac to determine when the pigment particles were dispersed down to the primary particle size. Into a four liter plastic container was added the 1211.765 g of well mixed pigment dispersion, along with 159.735 g of high molecular weight amorphous polyester resin dispersion (copoly(propoxylated/ethoxylated bisphenol A-terephthalate-dodecenylsuccinic anhydride-trimellitic anhydride), 40.25 wt %), 161.706 g of low molecular weight polyester amorphous resin dispersion (poly(propoxylated-bisphenol A—terephthalate-dodencylsuccinic anhydride), 39.76 wt %), 110.505 g of crystalline resin dispersion (poly(nonane-dodecanoate), 31.40 wt %), and 1280.201 g of water. This mixture was then pH adjusted to 4.2 using 69.2 g of 0.3M $HNO_3$ acid. Separately, a solution of 8.977 g $Al_2(SO_4)_3$ (27.85 wt %) and 110.712 g of water was added in as a flocculent under homogenization at 3500 rpm. The mixture was then added into a four liter stainless steel reactor equipped with an overhead mixer, and stirred at 200 rpm as the mixture was heated to 48° C. When the temperature of the mixture reached steady state, the rpm was increased to 400 and particle size was monitored with a Coulter Counter until the core particles reached a volume average particle size of 6.684 μm, a GSD volume of 1.246, and a GSD number of 1.578. A shell material containing 177.483 g and 179.673 g of the above mentioned high molecular weight and low molecular weight resin dispersions and 202.844 g of water was pH adjusted to 3.3 using 42.6 g of 0.3M $HNO_3$ and added to the reaction slurry as the rpm of the overhead mixer was gradually decreased to 220. This resulted in a core-shell structured particle with an average size of 8.240 μm, a GSD volume of 1.207, and a GSD number of 1.279. Thereafter, the rpm of the overhead mixer was decreased to 70 and the pH of the reaction slurry was increased to 8.2 using a solution consisting of 57.692 g of the chelating agent Veresene100, and 346.154 g of water to freeze the toner particles growth. 61.9 g of 0.3M $HNO_3$ was used to maintain pH 8.2 during this step. Once the toner particles were frozen, 11.1 g of Calfax was added to the reaction slurry. The rpm was then increased to 160 and the reaction slurry was heated to 85° C., with 24.0 g of 4 wt % NaOH needed to maintain pH at 8.2 for coalescence. The particles were left mixing at this temperature until the measured circularity was found to be 0.949. The toner was then quenched in ice water to stop coalescence, resulting in a final average particle size of 8.593 μm, GSD volume of 1.226, GSD number of 1.266, and a circularity of 0.953. The toner slurry was then cooled to room temperature, separated by sieving (25 μm), filtration, followed by washing and freeze dried.

Example 7

This EA toner was prepared using a batch aggregation continuous coalescence process.

Into a two liter plastic container was added 250 g of dry $TiO_2$ R900, 16.67 g of Calfax, and 1257.206 g of water. This solution was then put under a homogenizer at 3000 rpm, and samples were tested with the Nanotrac to determine when the pigment particles were dispersed down to the primary particle size. Into a four liter plastic container was added the 1514.706 g of well mixed pigment dispersion, along with 96.348 g of high molecular weight amorphous resin dispersion (copoly(propoxylated/ethoxylated bisphenol A-terephthalate-dodecenylsuccinic anhydride-trimellitic anhydride), 40.25 wt %), 97.537 g of low molecular weight amorphous resin disperison (poly(propoxylated-bisphenol A—terephthalate-dodencylsuccinic anhydride), 39.76 wt %), 110.505 g of crystalline resin dispersion (poly(nonane-dodecanoate), 31.40 wt %), and 1114.459 g of water. This mixture was then pH adjusted to 4.2 using 63.5 g of 0.3M $HNO_3$ acid. Separately a solution of 8.977 g $Al_2(SO_4)_3$ (27.85 wt %) and 110.712 g of water was added in as a flocculent under homogenization at 3500 rpm. The mixture was then added into a four liter stainless steel reactor equipped with an overhead mixer, and stirred at 200 rpm as the mixture was heated to 48° C. When the temperature of the mixture reached steady state, the rpm was increased to 400 and particle size was monitored with a Coulter Counter until the core particles reached a volume average particle size of 5.571 μm, a GSD volume of 1.226, and a GSD number of 1.378. A shell material containing 177.483 g and 179.673 g of the above mentioned high molecular weight and low molecular weight resin dispersions and 202.844 g of water was pH adjusted to 3.3 using 40.9 g of 0.3M $HNO_3$ and added to the reaction slurry as the rpm of the overhead mixer was gradually decreased to 220. This resulted in a core-shell structured particle with an average size of 7.828 μm, a GSD volume of 1.219, and a GSD number of 1.261. Thereafter, the rpm of the overhead mixer was decreased to 70 and the pH of the reaction slurry was increased to 8.2 using a solution consisting of 57.69 g of the chelating agent Veresene100, and 346.154 g of water to freeze the toner particles growth. 76.4 g of 0.3M $HNO_3$ was used to maintain pH 8.2 during this step. Once the toner particles were frozen, 11.1 g of Calfax was added to the reaction slurry. The slurry was then cooled to 25° C., pH adjusted to 6.8 using 23.2 g sodium acetate/acidic acid buffer, and diluted with 600 mL of water. The toner particles were then fed into the continuous coalescence process, which was pre-heated to 97° C. and operated at a flow rate of 240 mL/min. The coalesced toner particles collected at the outlet were then sieved inline, washed, and freeze dried. The final particles had an average particle size of 7.739 μm, GSD volume of 1.255, GSD number of 1.276 and particle circularity of 0.968.

Example 8

This EA toner was prepared using a batch aggregation continuous coalescence process.

Into a two liter plastic container was added 250 g of dry $TiO_2$ R900, 16.67 g of Calfax, and 1257.206 g of water. This solution was then put under a homogenizer at 3000 rpm, and samples were tested with the Nanotrac to determine when the pigment particles were dispersed down to the primary particle size. Into a four liter plastic container was added the 1514.706 g of well mixed pigment dispersion, along with 96.348 g of high molecular weight amorphous resin dispersion (copoly(propoxylated/ethoxylated bisphenol A-terephthalate-dodecenylsuccinic anhydride-trimellitic anhydride), 40.25 wt %), 97.537 g of low molecular weight amorphous resin dispersion (poly(propoxylated-bisphenol A—terephthalate-dodencylsuccinic anhydride), 39.76 wt %), 110.505 g of crystalline resin dispersion (poly(nonane-dodecanoate), 31.40 wt %), and 1115.459 g of water. This mixture was then pH adjusted to 4.2 using 62.5 g of 0.3M $HNO_3$ acid. Separately a solution of 8.977 g $Al_2(SO_4)_3$ (27.85 wt %) and 110.712 g of water was added in as a flocculent under homogenization at 3500 rpm. The mixture was then added into a four liter stainless steel reactor equipped with an overhead mixer, and stirred at 200 rpm as the mixture was heated to 48° C. When the temperature of the mixture reached steady state, the rpm was increased to 400 and particle size was monitored with a Coulter Counter until the core particles reached a volume average particle size of 5.764 μm, a GSD volume of 1.233, and a GSD number of 1.410. A shell material containing 177.483 g and 179.673 g of the above mentioned high molecular weight and low molecular weight resin dispersions and 202.844 g of water was pH adjusted to 3.3 using 44.0 g of 0.3M $HNO_3$ and added to the reaction slurry as the rpm of the overhead mixer was gradually decreased to 220. This resulted in a core-shell structured particle with an average size of 7.828 μm, a GSD volume of 1.226, and a GSD number of 1.269. Thereafter, the rpm of the overhead mixer was decreased to 70 and the pH of the reaction slurry was increased to 8.2 using a solution consisting of 57.69 g of the chelating agent Veresene100, and 346.154 g of water to freeze the toner particles growth. 83.0 g of 0.3M $HNO_3$ was used to maintain pH 8.2 during this step. Once the toner particles were frozen, 11.1 g of Calfax was added to the reaction slurry. The slurry was then cooled to 25° C., pH adjusted to 6.8 using 24.2 g sodium acetate/acidic acid buffer, and diluted with 600 mL of water. The toner particles were then fed into the continuous coalescence process, which was pre-heated to 97° C. and operated at a flow rate of 240 mL/min. The coalesced toner particles collected at the outlet were then sieved inline, washed, and freeze dried. The final particles had an average particle size of 7.917 μm, GSD volume of 1.262, GSD number of 1.276 and particle circularity of 0.962.

Example 9

This EA toner was prepared using a batch aggregation continuous coalescence process.

Into a two liter plastic container was added 200 g of dry TiO2 R900, 13.33 g of Calfax, and 1005.765 g of water. This solution was then put under a homogenizer at 3000 rpm, and samples were tested with the Nanotrac to determine when the pigment particles were dispersed down to the primary particle size. Into a four liter plastic container was added the 1211.765 g of well mixed pigment dispersion, along with 159.735 g of high molecular weight amorphous resin dispersion, (copoly(propoxylated/ethoxylated bisphenol A-terephthalate-dodecenylsuccinic anhydride-trimellitic anhydride), 40.25 wt %), 161.706 g of low molecular weight amorphous resin dispersion (poly(propoxylated-bisphenol A—terephthalate-dodencylsuccinic anhydride), 39.76 wt %), 110.505 g of crystalline resin dispersion (poly(nonane-dodecanoate), 31.40 wt %), and 1282.001 g of water. This mixture was then pH adjusted to 4.2 using 67.4 g of 0.3M $HNO_3$ acid. Separately a solution of 8.977 g $Al_2(SO_4)_3$ (27.85 wt %) and 110.712 g of water was added in as a flocculent under homogenization at 3500 rpm. The mixture was then added into a four liter stainless steel reactor equipped with an overhead mixer, and stirred at 200 rpm as the mixture was heated to 48° C. When the temperature of the mixture reached steady state, the rpm was increased to 400 and particle size was monitored with a Coulter Counter until the core particles reached a volume average particle size of 6.100 μm, a GSD volume of 1.241, and a GSD number of 1.392. A shell material containing 177.483 g and 179.673 g of the above mentioned high molecular weight and low molecular weight resin dispersions and 202.844 g of water was pH adjusted to 3.3 using 42.7 g of 0.3M $HNO_3$ and added to the reaction slurry as the rpm of the overhead mixer was gradually decreased to 220. This resulted in a core-shell structured particle with an average size of 8.001 μm, a GSD volume of 1.212, and a GSD number of 1.240. Thereafter, the rpm of the overhead mixer was decreased to 70 and the pH of the reaction slurry was increased to 8.2 using a solution consisting of 57.69 g of the chelating agent Veresene100, and 346.154 g of water to freeze the toner particles growth. 59.6 g of 0.3M $HNO_3$ was used to maintain pH 8.2 during this step. Once the toner particles were frozen, 11.1 g of Calfax was added to the reaction slurry. The slurry was then cooled to 25° C., pH adjusted to 6.8 using 26.4 g sodium acetate/acidic acid buffer, and diluted with 600 mL of water. The toner particles were then fed into the continuous coalescence process, which was pre-heated to 97° C. and operated at a flow rate of 240 mL/min. The coalesced toner particles collected at the outlet were then sieved inline, washed, and freeze dried. The final particles had an average particle size of 8.099 μm, GSD volume of 1.233, GSD number of 1.276 and particle circularity of 0.960.

Example 10

This EA toner was prepared using a batch process.

Into a large container was added 4.95 kg of dry $TiO_2$ R900, 0.33 kg of Calfax, and 24.893 kg of water. This solution was then put under a homogenizer at 3000 rpm, and samples were tested with the Nanotrac to determine when the pigment particles were dispersed down to the primary particle size. Into a 20 gallon stainless steel reactor equipped with an overhead mixer and temperature controlled jacket was added the 29.991 kg of well mixed pigment dispersion, along with 2.817 kg of high molecular weight amorphous resin dispersion (copoly(propoxylated/ethoxylated bisphenol A-terephthalate-dodecenylsuccinic anhydride-trimellitic anhydride), 40.25 wt %), 2.852 kg of low molecular weight amorphous resin dispersion (poly(propoxylated-bisphenol A—terephthalate-dodencylsuccinic anhydride), 39.76 wt %), 2.431 kg of crystalline resin dispersion (poly(nonane-dodecanoate), 31.40 wt %), and 25.764 kg of water. This mixture was then pH adjusted to 4.2 using 1.5 kg of 0.3M $HNO_3$ acid. Separately a solution of 0.197 kg $Al_2(SO_4)_3$ (27.85 wt %) and 2.436 kg of water was added in as a flocculent under homogenization at 3500 rpm. The mixture was stirred at 150 to 200 rpm as the mixture was heated to 49° C. The particle size was monitored with a Coulter Counter until the core particles reached a volume average particle size of 6.477 μm, a GSD volume of 1.219, and a GSD number of 1.472. A shell material containing 3.905 kg and 3.953 kg of the above mentioned high molecular weight and low molecular weight resin dispersions and 4.463 kg of water was pH adjusted to 3.3 using 1.1 kg of 0.3M $HNO_3$ and added to the reaction slurry as the rpm of the overhead mixer was gradually decreased to 150. This resulted in a core-shell structured particle with an average size of 8.503 μm, a GSD volume of 1.232, and a GSD number of 1.321. Thereafter, the rpm of the overhead mixer was decreased to 125 and the pH of the reaction slurry was increased to 8.0 using a solution consisting of 1.269 kg of the chelating agent Veresene100, and approximately 1.4 kg of 0.3 M $HNO_3$ was used to maintain pH 8.0 during this step. Once the toner particles were frozen, 0.244 kg of Calfax and 0.506 kg NaOH was added to the reaction slurry and heated to 85° C. for coalescence. Particle coalescence continued for 105 minutes to produce particles with average particle size of 8.774 μm, GSD volume of 1.259, GSD number of 1.552 and circularity of 0.945. The slurry was then cooled to 25° C., and the coalesced toner particles collected at the outlet were then sieved through a 50 micron bag filter, washed, and dried. The final particles had an average particle size of 7.92 μm, GSD volume of 1.27, GSD number of 1.40 and particle circularity of 0.947.

Example 11

The quality of the pigment dispersion within the interior of the particle contributes significantly to meeting the lightness (L*) target of higher than 75. Evaluation of the quality of the $TiO_2$ dispersion in the final toner particles was assessed by transmission electron microscope (TEM) and scanning electron microscope (SEM) imaging techniques.

Figure 2:
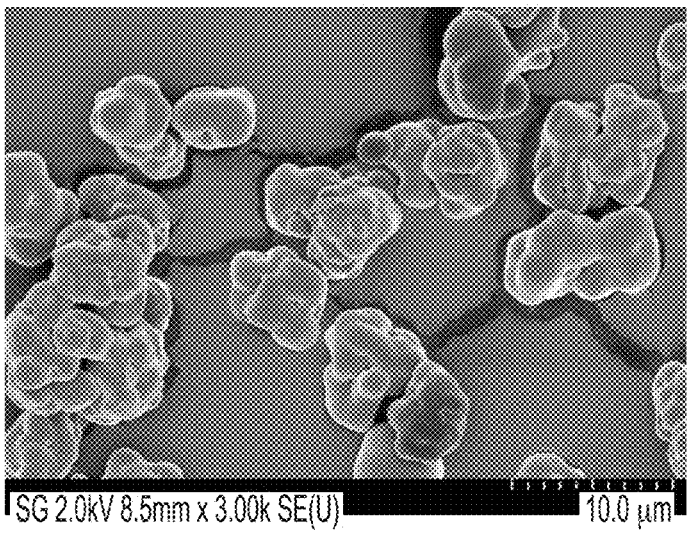
FIG. 2 is a scanning electron microscope (SEM) photograph, at a magnification of 3,000 times illustrating smooth particle surfaces of the EA particles of Example 1 prepared according to certain embodiments of the present disclosure.
Figure 3:
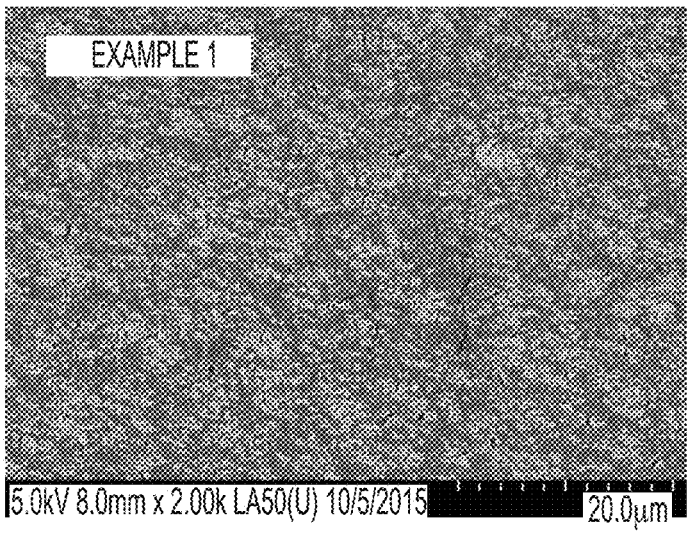
FIG. 3 is a SEM photograph, at a magnification of 2,000 times, of a cross-sectional view of $TiO_2$ pigment dispersion within EA particles of Example 1 prepared according to certain embodiments of the present disclosure.
Figure 4:
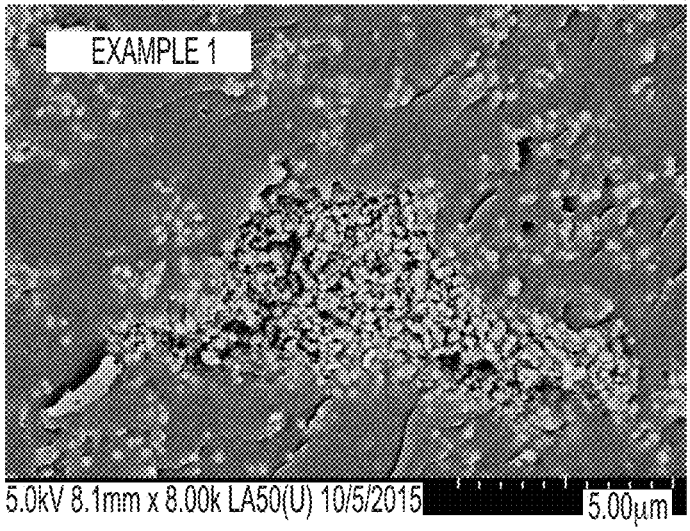
FIG. 4 is a SEM photograph, at a magnification of 8,000 times, of a cross-sectional view of $TiO_2$ pigment dispersion within EA particles of Example 1 prepared according to certain embodiments of the present disclosure.

FIG. 1 is a TEM photograph of a cross-sectional view of $TiO_2$ pigment dispersion within EA particles of Example 1. $TiO_2$ pigments (shown as black dots) are surrounded by amorphous polyester resin. Surface additive, such as a surface treated sol-gel silica, e.g., X24 available from Shin-Etsu Chemical Co. (shown as small like grey dots) which defines the toner particle edge. FIGS. 2-4 are SEM images of a cross-sectional view of the same particle sample of Example 1. FIG. 2 is a SEM image at a magnification of 3,000 times which shows a smooth surface. FIG. 3 is a SEM image at a magnification of 2,000 times. FIG. 4 is a SEM image at a magnification of 8,000 times where agglomerates are visible.

Figure 5:
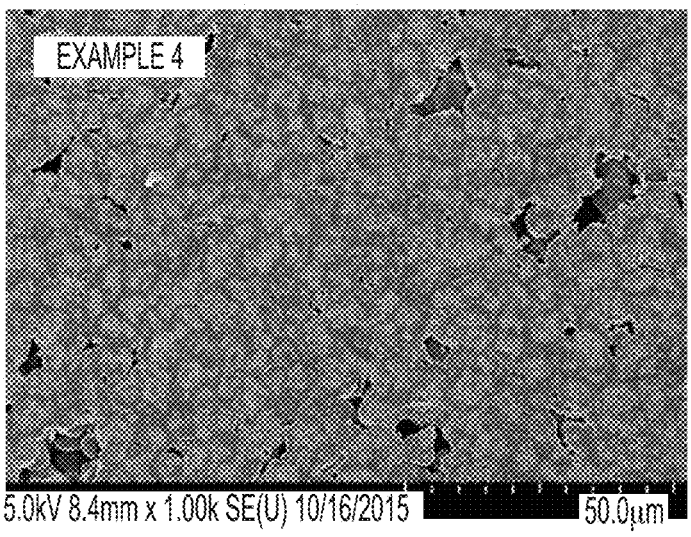
FIG. 5 is a SEM photograph, at a magnification of 1,000 times, of a cross-sectional view of $TiO_2$ pigment dispersion within EA particles of Example 4 prepared according to certain embodiments of the present disclosure.
Figure 6:
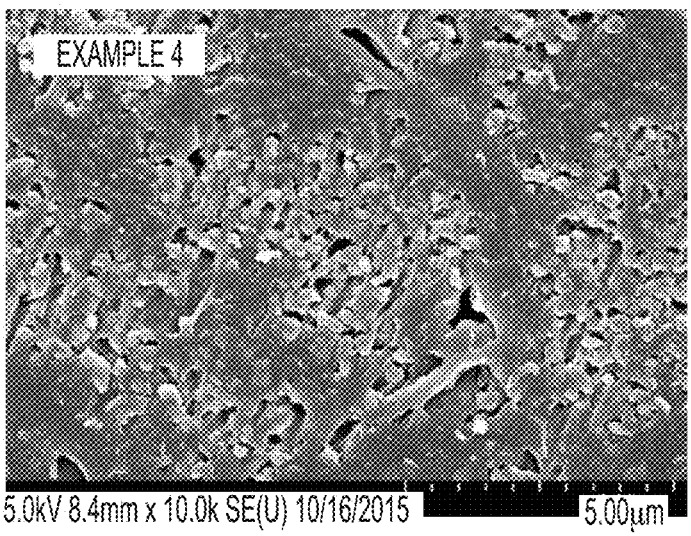
FIG. 6 is a SEM photograph, at a magnification of 10,000 times, of a cross-sectional view of $TiO_2$ pigment dispersion within EA particles of Example 4 prepared according to certain embodiments of the present disclosure.
Figure 7:
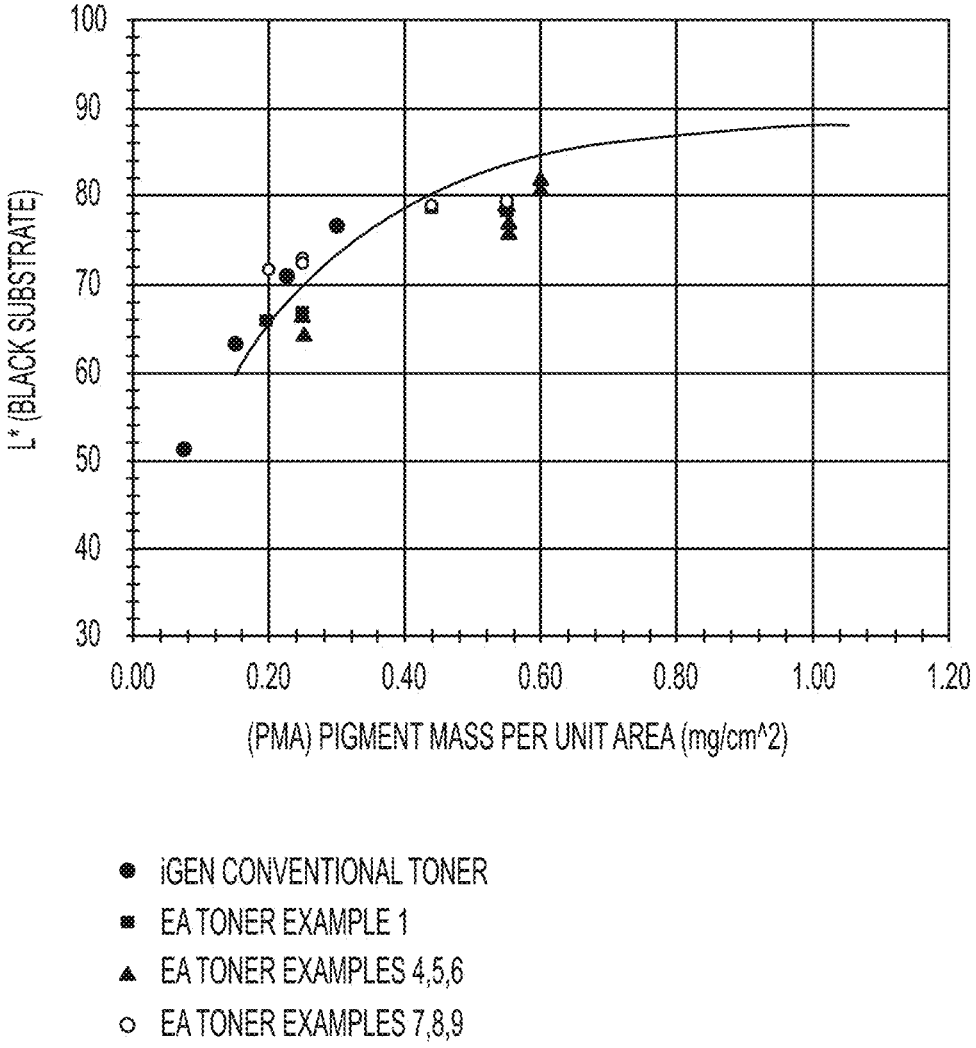
FIG. 7 is a graph depicting lightness (L*) versus pigment mass per unit area (PMA) for conventional toners (see comments in drawings) and EA toners Examples 4-9 prepared according to certain embodiments of the present disclosure.

FIGS. 5-6 are SEM images of a cross-sectional view of a EA toner particles of Example 4 prepared by pressed pellet at 60° C. The tone particle includes pre-dispersed 50% $TiO_2$ pigment, no wax, and crystalline and amorphous polyester resins. FIG. 5 is a SEM image at a magnification of 1,000 times. FIG. 6 is a SEM image at a magnification of 10,000 times which shows well dispersed $TiO_2$ pigment.

When the $TiO_2$ pigment was pre-dispersed into an aqueous surfactant solution (such as the surfactant solution described above containing 50% $TiO_2$ pigment and crystalline and amorphous polyester resins) prior to homogenization, the frequency of pigment agglomerates was reduced as shown in FIGS. 5-6.

Example 12

EA toner Examples 1 and 4-9 were machine tested to determine the lightness (L*) against pigment mass per unit area. White images on black substrate were evaluated. Table 2 shows the L* at 0.5 and 1.1 toner mass per area (TMA).

TABLE 2

| Examples | Pigment Loading (wt %) | Corrected B-Zone Tribo (uC/g) | Mean TC % | Color-L* at 0.5 TMA | Color-L* at 1.1 TMA |
|---|---|---|---|---|---|
| Example 1 | 40 | 31.7 | 3.8 | 65.7 | 78.6 |
| Example 4 | 50 | 25.65 | 3.4 | 64.9 | 75.9 |
| Example 5 | 50 | 21.55 | 4.2 | 66.7 | 79.2 |
| Example 6 | 40 | 34.15 | 4.1 | 64.5 | 77.1 |
| Example 9 | 40 | 30.5 | 3.7 | | 76.2 |
| Example 10 | 45 | 23.4 | 4.4 | | 77.5 |

Example 13

Figure 8:
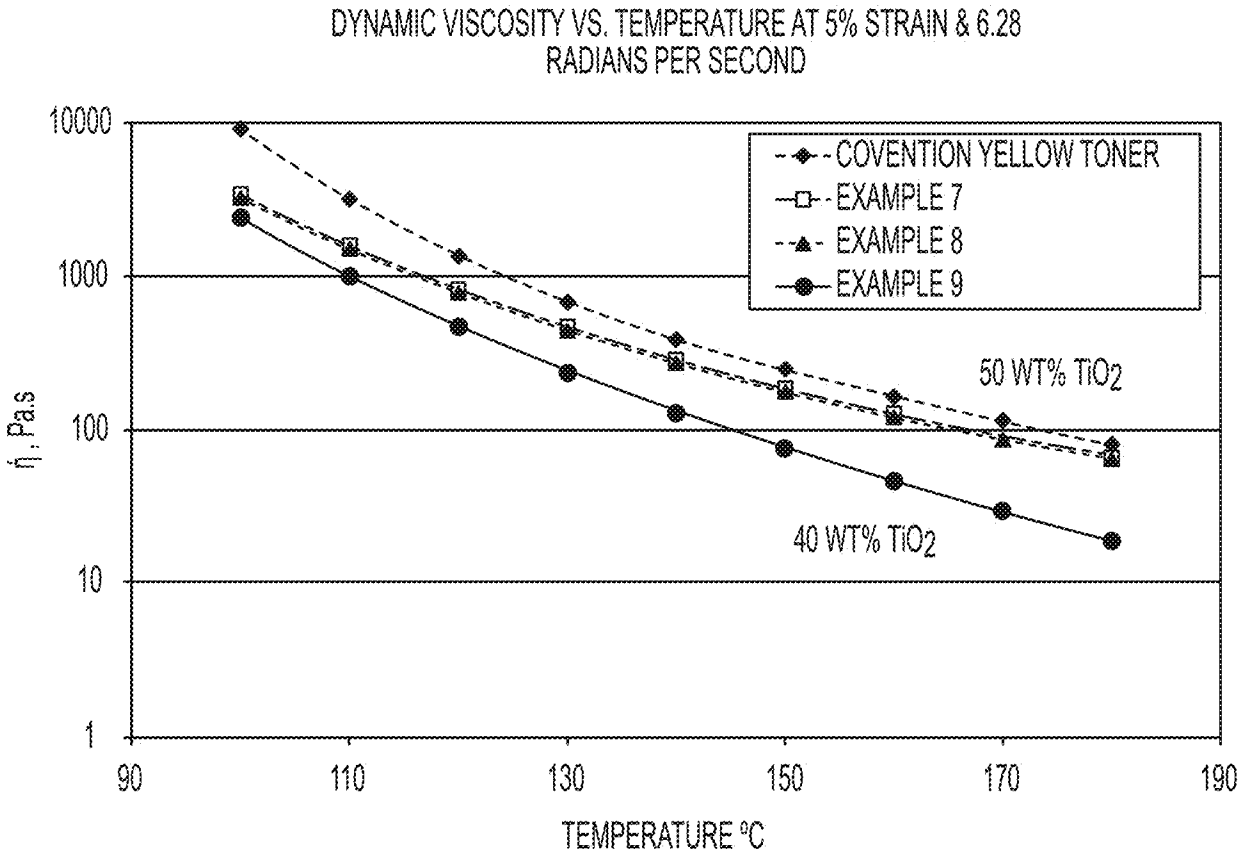
FIG. 8 is a graph depicting dynamic viscosity versus temperature for a conventional yellow toner and EA toners Examples 7-9 prepared according to certain embodiments of the present disclosure.

The dynamic viscosity of the Conventional Yellow Toner and EA toners Examples 7-9 were measured using TA instrument's ARES G2 Rheometer. FIG. 8 is a graph showing the relationships between temperature and the dynamic viscosity coefficients of the EA toners. The dynamic viscosity as a function of temperature for the 50 wt % white EA toners (i.e., Examples 7 and 8) is slightly lower or similar to that of the conventional yellow toner. This indicates that both EA toners will have good fusing performance comparable to the yellow conventional toner control. The dynamic viscosity as a function of temperature for the 40 wt % white EA toner (i.e., Example 9) is lower as compared to that of the conventional yellow toner, which is very desirable. This viscosity performance is due to the presence of the crystalline polyester resin and lack of a cross-linked resin in the particle formulation which enables high pigment loadings without increase viscosity above the target range.

Example 14

Toner charging was collected for the parent particle for the conventional toners and a series of EA white toners of different pigment loadings.

Charging characteristics were determined by testing developers made by combining about 4.5 grams of the EA Toner with about 100 grams of carrier (65 micron steel core, Hoeganaes Corporation) coated with about 1% by weight of polymethylmethacrylate. The developers are aggressively mixed in a paint shaker (Red Devil 5400, modified to operate between 600 and 650 RPM) for a period of 10 minutes. It is believed that this process simulates a mechanical energy input to a toner particle equivalent to that applied in a xerographic housing environment in a low toner throughout mode, that is, a xerographic housing producing a print in which from about 0 to about 2 percent of the print is covered by toner developed from that housing for a period of about 100 to about 10,000 impressions. The triboelectric charge is measured for the Comparative Examples 1-3 conditioned in three zones—A-zone (80° F./80% RH), B-zone (70° F./50% RH) and J-zone (70° F./10% RH), and the results are illustrated in Table 3.

TABLE 3

| Comparative Toners | Description | Tribo A zone | Tribo B zone | Tribo J zone |
|---|---|---|---|---|
| Comparative Example 1 | 20 wt % $TiO_2$ Pigment | 14.67 | 27.89 | 41.74 |
| Example 2 | 30 wt % $TiO_2$ Pigment | 11.34 | 25.01 | 35.39 |
| Comparative Example 3 | 40 wt % $TiO_2$ Pigment | 9.49 | 20.53 | 28.54 |

The triboelectric charge is measured for the Examples 1, 4-6, 9 and 10 conditioned in B-zone (74° F./44-47% RH), and the results are illustrated in Table 2 above.

The parent particle charges in B-zone for the EA white toners containing 40 wt % of pigment (Examples 1, 6 and 9) shown in Table 3 are higher as compared to that of the white conventional toner (Comparative Example 1) shown in Table 2. Therefore, the EA toners prepared according to the present disclosure exhibit unexpected results (higher charges) compared to conventional toners at the same pigment loadings and even at lower pigment loadings.

Typically, the parent particle exhibits higher charges with lower pigment loadings. Because $TiO_2$ pigment is conductive, when a high enough amount of $TiO_2$ pigment is exposed on the surface of the toner particles, the toner charge may drop. Therefore, this explains that the white toner by the conventional route may exhibits lower charge at higher $TiO_2$ pigment loadings due to a certain amount of $TiO_2$ pigment is exposed on the surface of the toner particles. On the other hand, in EA toners, the $TiO_2$ pigment is encapsulated within the toner shell and is not exposed at the toner particle surface. This enables high toner charge even at high pigment loadings.

While the description above refers to particular embodiments, it will be understood that many modifications may be made without departing from the spirit thereof. The accompanying claims are intended to cover such modifications as would fall within the true scope and spirit of embodiments herein.

The presently disclosed embodiments are, therefore, to be considered in all respects as illustrative and not restrictive, the scope of embodiments being indicated by the appended claims rather than the foregoing description. All changes that come within the meaning of and range of equivalency of the claims are intended to be embraced therein.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

All the patents and applications referred to herein are hereby specifically, and totally incorporated herein by reference in their entirety in the instant specification.

What is claimed is:

1. An emulsion aggregation toner having toner particles comprising one single white colorant consisting of titanium dioxide having a specific gravity of from 3.6 to 4.3, wherein the single white colorant is present in an amount of from about 35 weight percent to 60 weight percent by weight of the toner;

a crystalline polyester resin; and an amorphous polyester resin;

wherein the toner exhibits a lightness (L*) of from about 75 to about 95 at a pigment mass per unit area of from about 0.2 $mg/cm^2$ to about 1.5 $mg/cm^2$ based on the surface area of a black substrate.

2. The toner composition of claim 1 having a mean particle size of from about 5 microns to about 20 microns.

3. The toner composition of claim 1, wherein the crystalline polyester resin is selected from the group consisting of poly(ethylene-adipate), poly(propylene-adipate), poly (butylene-adipate), poly(pentylene-adipate), poly(hexylene-adipate), poly(octylene-adipate), poly(ethylene-succinate), polypropylene-succinate), poly(butylene-succinate), poly (pentylene-succinate), poly(hexylene-succinate), poly(octylene-succinate); poly(ethylene-sebacate), poly(propylene-sebacate), poly(butylene-sebacate), poly(pentylene-sebacate), poly(hexylene-sebacate), poly(octylene-sebacate), poly(decylene-sebacate), poly(decylene-decanoate), poly(ethylene-decanoate), poly(ethylene dodecanoate), poly(hexane-dodecanoate), poly(nonylene-sebacate), poly(nonylene-decanoate), poly(nonane-dodecanoate), copoly(ethylene-fumarate)-copoly(ethylene-sebacate), copoly(ethylene-fumarate)-copoly(ethylene-decanoate), copoly(ethylene-fumarate)-copoly(ethylene-dodecanoate), poly(ethylene-adipamide), poly(propylene-adipamide), poly(butylenes-adipamide), poly(pentylene-adipamide), poly(hexylene-adipamide), poly(octylene-adipamide), polyethylene-succinimide), and poly (propylene-sebecamide), polyethylene-adipimide), poly (propylene-adipimide), poly(butylene-adipimide), poly (pentylene-adipimide), poly(hexylene-adipimide), poly (octylene-adipimide), poly(ethylene-succinimide), poly (propylene-succinimide), polybutylene-succinimide), and mixtures thereof.

4. The toner composition of claim 1, wherein the crystalline polyester resin is presented in an amount of from about 5 weight percent to 25 weight percent by weight of the toner.

5. The toner composition of claim 1, wherein the amorphous polyester resin is selected from the group consisting of propoxylated bisphenol A fumarate resin, poly(propoxylated bisphenol co-fumarate), poly(ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly(propoxylated bisphenol co-maleate), poly(ethoxylated bisphenol co-maleate), poly(butyloxylated bisphenol co-maleate), poly (co-propoxylated bisphenol co-ethoxylated bisphenol co-maleate), poly(1,2-propylene maleate), poly(propoxylated bisphenol co-itaconate), poly(ethoxylated bisphenol co-itaconate), poly(butyloxylated bisphenol co-itaconate), poly(co-propoxylated bisphenol co-ethoxylated bisphenol co-itaconate), poly(1,2-propylene itaconate), a copoly (propoxylated bisphenol A co-fumarate)-copoly(propoxylated bisphenol A co-terephthalate), a terpoly (propoxylated bisphenol A co-fumarate)-terpoly(propoxylated bisphenol A co-terephthalate)-terpoly-(propoxylated bisphenol A co-dodecylsuccinate), and mixtures thereof.

6. The toner composition of claim 1, wherein the amorphous polyester resin is presented in an amount of from about 20 weight percent to 60 weight percent by weight of the toner.

7. The toner composition of claim 1, wherein the amorphous polyester resin having an average weight molecular weight of from about 45,000 to about 150; 000.

8. The toner composition of claim 1, wherein the amorphous polyester resin having an average weight molecular weight of from about 10,000 to about 30,000.

9. The toner composition of claim 1, wherein the toner composition further comprises a surfactant selected from the group consisting of an anionic surfactant, a nonionic surfactant, and mixtures thereof.

10. The toner composition of claim 9, wherein the anionic surfactant comprises diphenyl oxide disulfonate.

11. The toner composition of claim 1, wherein the toner composition does not contain a cross-linked resin.

12. The toner composition of claim 1, wherein the toner composition is a dry powder.

13. The toner composition of claim 1, wherein the one single type of white colorant is titanium dioxide having a specific gravity of from 4.0 to 4.3.

14. An emulsion aggregation toner having toner particles comprising one single white colorant consisting of titanium dioxide having a specific gravity of from 3.6 to 4.3, wherein the single white colorant is present in an amount of from about 35 weight percent to 55 weight percent by weight of the toner;

a crystalline polyester resin;

an amorphous polyester resin; and an anionic surfactant;

wherein the toner exhibits a lightness (L*) of from about 75 to about 95 at a pigment mass per unit area from about 0.2 $mg/cm^2$ to about 1.5 $mg/cm^2$ based on the surface area of a black substrate.

15. The toner composition of claim 14, wherein the L* is from about 80 to about 90.

16. The toner composition of claim 14, wherein the amorphous polyester resin comprises a high average weight molecular weight amorphous polyester resin of from about 45,000 to about 150,000 and a low average weight molecular weight amorphous polyester resin of from about 10,000 to about 30,000.

17. The toner composition of claim 14, wherein anionic surfactant comprises diphenyl oxide disulfonate.

18. The toner composition of claim 14 having a mean particle size of from about 6 microns to about 10 microns.

19. The toner composition of claim 14, wherein the crystalline polyester resin is selected from the group consisting of poly(ethylene-adipate), poly(propylene-adipate), poly(butylene-adipate), poly(pentylene-adipate), poly(hexylene-adipate), poly(octylene-adipate), poly(ethylene-succinate), polypropylene-succinate), poly(butylene-succinate), poly(pentylene-succinate), poly(hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate), poly(decylene-sebacate), poly(decylene-decanoate), poly(ethylene-decanoate), poly(ethylene dodecanoate), poly(hexane-dodecanoate), poly(nonylene-sebacate), poly(nonylene-decanoate), poly(nonane-dodecanoate), copoly(ethylene-fumarate)-copoly(ethylene-sebacate), copoly(ethylene-fumarate)-copoly(ethylene-decanoate), copoly(ethylene-fumarate)-copoly(ethylene-dodecanoate), poly(ethylene-adipamide), poly(propylene-adipamide), poly(butylenes-adipamide), poly(pentylene-adipamide), poly(hexylene-adipamide), poly(octylene-adipamide), poly(ethylene-succinimide), and poly(propylene-sebecamide), poly(ethylene-adipimide), poly(propylene-adipimide), poly(butylene-adipimide), poly(pentylene-adipimide), poly(hexylene-adipimide), poly(octylene-adipimide), poly(ethylene-succinimide), poly(propylene-succinimide), polybutylene-succinimide), and mixtures thereof.

* * * * *